US012320601B2

(12) United States Patent
Srsen

(10) Patent No.: US 12,320,601 B2
(45) Date of Patent: Jun. 3, 2025

(54) CONCEALABLE PISTOL

(71) Applicant: Davor Srsen, Windsor (CA)

(72) Inventor: Davor Srsen, Windsor (CA)

( * ) Notice: Subject to any disclaimer, the term of this patent is extended or adjusted under 35 U.S.C. 154(b) by 0 days.

(21) Appl. No.: 18/100,761

(22) Filed: Jan. 24, 2023

(65) Prior Publication Data

US 2023/0235983 A1 Jul. 27, 2023

Related U.S. Application Data

(60) Provisional application No. 63/302,583, filed on Jan. 25, 2022.

(51) Int. Cl.

| | |
|---|---|
| ***F41A 19/40*** | (2006.01) |
| ***F41A 11/04*** | (2006.01) |
| ***F41A 17/64*** | (2006.01) |
| ***F41C 9/02*** | (2006.01) |

(52) U.S. Cl.

CPC ..... *F41A 19/40* (2013.01); *F41A 11/04* (2013.01); *F41A 17/64* (2013.01); *F41C 9/02* (2013.01)

(58) Field of Classification Search

CPC ..... F41A 3/66; F41A 9/24; F41A 9/25; F41A 17/64; F41A 11/04; F41A 19/40; F41C 9/02

USPC ..... 42/2

See application file for complete search history.

(56) References Cited

U.S. PATENT DOCUMENTS

| | | | | | |
|---|---|---|---|---|---|
| 597,588 | A * | 1/1898 | Nygren | F41A 17/38 | 42/7 |
| 1,519,806 | A * | 12/1924 | Wesson | F41A 9/47 | 42/11 |
| 2,057,169 | A * | 10/1936 | Swenson | F41A 9/76 | 89/33.03 |
| 3,554,425 | A * | 1/1971 | Oesterle | B25C 1/186 | 227/95 |
| 4,856,410 | A * | 8/1989 | Anderson | F41C 7/02 | 89/155 |
| 5,299,373 | A * | 4/1994 | Breiner | F41A 9/25 | 42/15 |
| 5,784,821 | A * | 7/1998 | Gerard | F41A 9/26 | 42/15 |
| 5,996,265 | A * | 12/1999 | Coury | F41A 9/25 | 42/59 |
| 6,065,237 | A * | 5/2000 | Hillesland | F41C 3/04 | 227/15 |

(Continued)

*Primary Examiner* — John Cooper

(74) *Attorney, Agent, or Firm* — Bennet K. Langlotz; Langlotz Patent & Trademark Works, LLC

(57) ABSTRACT

A pistol comprises a barrel connected to a frame that has a grip portion defining an elongated magazine well. A magazine defining a plurality of chambers is removably receivable within the well. A trigger assembly connected to the frame engages a magazine with a follower or cam surface by which trigger assembly advances the magazine within the well and indexes the magazine along its length to sequentially align each chamber with the barrel, and sequentially discharge each cartridge in the magazine. The follower elements may be arranged parallel to the length of the magazine so that each may be associated with a particular chamber. A "safety" condition is effectible by pushing a loaded magazine downward and into a concealable condition with its chambers out of alignment with the gun barrel and wherein a transfer bar safety blocks the hammer from inserting its firing pin into a magazine chamber.

2 Claims, 26 Drawing Sheets

(56) References Cited

U.S. PATENT DOCUMENTS

| | | | | |
|---|---|---|---|---|
| 6,571,499 | B1 * | 6/2003 | Dikov | F41A 9/25 42/15 |
| 8,756,843 | B1 * | 6/2014 | Cantrell | F41A 19/06 42/6 |
| 8,904,690 | B1 * | 12/2014 | Cantrell | F41A 19/06 42/6 |
| 10,060,689 | B2 * | 8/2018 | Grier | F41A 19/68 |
| 10,605,562 | B2 * | 3/2020 | DiBlasio | F41B 11/55 |
| 10,775,119 | B2 * | 9/2020 | Conle | F41A 17/20 |
| 10,955,207 | B1 * | 3/2021 | Puleo | F41A 9/79 |
| 2015/0184961 | A1 * | 7/2015 | Cantrell | F41A 9/24 42/7 |
| 2015/0354910 | A1 * | 12/2015 | Kerbrat | F41A 3/50 42/16 |
| 2017/0198994 | A1 * | 7/2017 | Grier | F41A 21/16 |
| 2023/0079588 | A1 * | 3/2023 | Ma | F41B 11/54 124/6 |
| 2023/0235983 | A1 * | 7/2023 | Srsen | F41A 19/10 42/2 |

* cited by examiner

A - A

A – A

A – A

B – B

D - D

D - D

A - A

C - C

C - C

C - C

C - C

C - C

C - C

C - C

B - B

B - B

C - C

C - C

C - C

CONCEALABLE PISTOL

CROSS-REFERENCE TO RELATED APPLICATIONS

This application claims the benefit of U.S. Provisional Patent Application No. 63/302,583, filed on Jan. 25, 2022, entitled "CONCEALABLE POCKET PISTOL", which is hereby incorporated by reference in its entirety for all that is taught and disclosed therein.

FIELD OF THE INVENTION

The present invention relates to compact and concealable repeating firearms.

BACKGROUND AND SUMMARY

People who desire the personal protection capabilities of firearms have long sought to carry them close at hand yet discreetly. In some cultural spaces the mere presence of a lawfully possessed firearm may be disconcerting to others and in some jurisdictions concealed possession of a firearm is additionally constrained by requirements that the firearm not only be not visible but prohibit "printing," which means that bulges on the exteriors of apparel, pistol carrying cases, or purses may not reveal or communicate the presence of a concealed firearm are also proscribed.

Therefore it is highly desirable for people who wish to carry concealed firearms for personal defense that the weapon be as small as possible on the one hand, but also be capable of discharging bullets of an effective caliber to neutralize a typical threat. Also, smaller people, people with smaller hands, and people with limited upper body strength prefer weapons chambered to smaller cartridges because these offer less recoil. Another desirable design feature is to hold the barrel axis as low and close to the gripping hand as possible to reduce torque to the hand from the recoil during firing, which is sometimes called "muzzle flip."

Decades of debate about the stopping power of pistol bullets against humans have mostly settled that while shot placement into or at least near vital organs or nerve bundles is a paramount requirement, cartridges such as the 0.38 Special and the 9 mm×19 Luger ("Parabellum") represent recognizable minimum-sized choices having histories of effective performance in after action reports of military, law enforcement, and personal defense encounters.

The above disadvantage is addressed by a pistol that comprises a barrel connected to a frame that has a grip portion defining an elongated magazine well. A magazine that defines a plurality of chambers is removably receivable within the well. A trigger assembly is connected to the frame and the magazine has a follower surface (which may also be referred to as a cam surface) with which trigger assembly engages to advance the magazine within the well and to index the magazine along its length to sequentially align each chamber with the barrel and sequentially discharge each cartridge in the magazine. The follower elements may be arranged in parallel along the length of the magazine so that each may be associated with a particular chamber. A "safety" condition is effectible by pushing a loaded magazine downward and into a concealable condition with its chambers out of alignment with the gun barrel and wherein a transfer bar safety blocks the hammer from inserting a firing pin into a magazine chamber.

DETAILED DESCRIPTION OF PREFERRED EMBODIMENTS

The invention is a concealable pistol of especially compact size and width and capable of being manufactured in effective calibers for neutralizing human aggressors, and able to carry a sufficient number of ammunition rounds for a user to prevail in most typical self-defense situations. The barrel length, while short, is long enough to impart serviceable accuracy at moderate range and long enough to accelerate the bullet enough for effective kinetic energy on impact. The concealable pistol may be drawn, safety disabled, and fired by a smooth single-handed operation without requiring two-handed support. The design as disclosed herein enables user to grip the pistol with all fingers, including the fifth digit of the hand or pinkie finger. In contrast, the grip of the Glock model 43 is not large enough to support the pinkie finger for most users' hands. Also, while concealed in an apparel pocket with the folding grip in its storage position, it produces a rectangular outline that looks more like a wallet and less like a pistol.

Figure 1A:
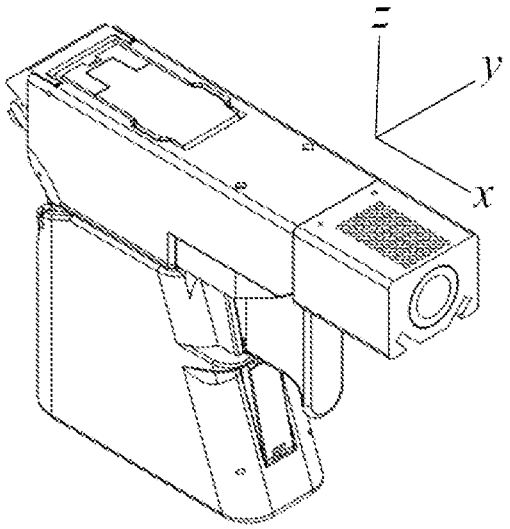
FIG. 1*a* shows an oblique, front right top view of an embodiment of a concealable pistol in accordance with the invention showing the grip folded to safe position and to telescoping muzzle device in collapsed position.

Referring now to the figures, FIG. 1*a* shows an oblique, front right top view of an embodiment of a concealable pistol in accordance with the invention showing the grip folded to safe position and to telescoping muzzle device in collapsed position. For convenience a reference coordinate system for defining common terms for orientations, motions, and view aspects of the figures and components is presented in this figure.

In this specification, direction indicating words such as "forward" means a first direction parallel to the shooting direction and the barrel axis of the weapon and in the direction of the bullet motion during discharge, and "rearward" is a direction parallel to "forward" but opposite to the bullet motion during discharge. "Forward and "rearward" directions are also "longitudinal" directions, and words such as "ahead" and "behind" shall be taken to mean an ordering of components proceeding along and parallel to a horizontal direction such as a direction proceeding from the muzzle end of the barrel to the chamber end of the barrel. Unless otherwise stated, a forward or longitudinal direction correlates to the "x" axis of this figure. A "transverse" or "lateral" direction is a direction parallel to a transverse axis residing at the intersection of an x-y plane and a z-y plane perpendicular to the barrel axis. A transverse direction correlates to the "y" axis of this figure. However, in some discussions of the magazine well or a magazine and its components, the word "longitudinal" may also be used to mean a direction along the major length dimension of the magazine.

A "vertical" direction is a direction along an axis perpendicular to both the barrel axis and a transverse axis intersecting the barrel axis. The words "up," "upward, "above," "top" and their complementary opposites "down," "downward," "beneath," "below," and "underside" shall be taken to indicate vertical motion, direction, orientation, or an ordering of components proceeding along a vertical direction. An upward direction correlates to the "z" axis of this figure. Also, in this specification the word "by" includes locative meanings such as "next to" or "proximate to" the entity to which it refers.

Figure 1B:
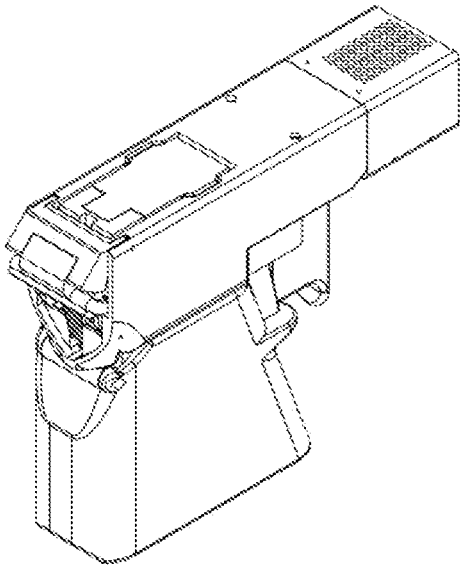
FIG. 1*b* shows an oblique, rear right top view of the pistol of FIG. 1*a*.
Figure 1C:
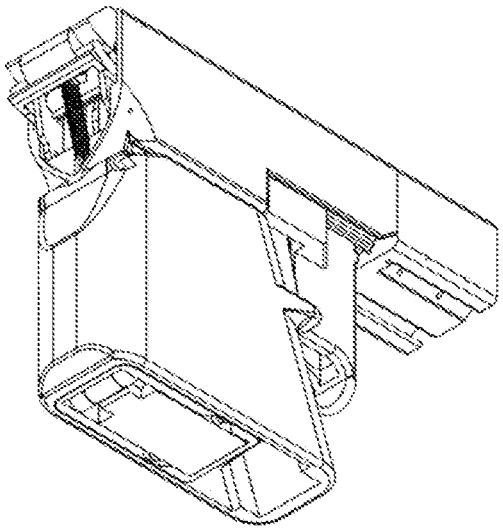
FIG. 1*c* shows an oblique, rear right bottom view of the pistol of FIG. 1*a*.
Figure 1D:
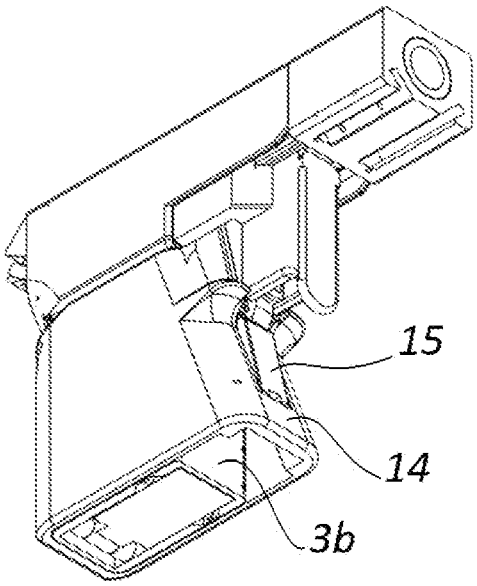
FIG. 1*d* shows an oblique, front right bottom view of the pistol of FIG. 1*a*.

FIG. 1*b* shows an oblique, rear right top view of the pistol of FIG. 1*a*. FIG. 1*c* shows an oblique, rear right bottom view of the pistol of FIG. 1*a*. FIG. 1*d* shows an oblique, front right bottom view of the pistol of FIG. 1*a*. The pistol includes a folding grip [14] that pivots on the frame near the web of the shooters hand, surrounding the lower portion or the magazine well portion [3*a*] of the frame, and which uses a latch [15] to snap onto a hook portion of the frame by the underside of the trigger. The latch retains the folding grip in a compact, concealable orientation reducing the perimeter of the pistol and reducing the required volume of an apparel pocket or carry purse.

Figure 2A:
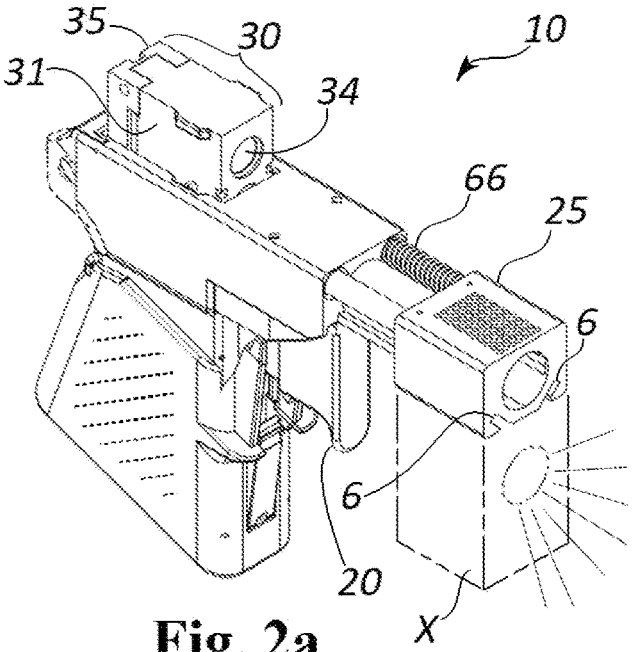
FIG. 2*a* shows an oblique, front right top view of the pistol of FIG. 1A, with the with the grip deployed into a firing position and the telescoping muzzle device in a deployed position and with the magazine elevated such as after firing the two uppermost cartridges in its magazine.

FIG. 2*a* shows an oblique, front right top view of the pistol [10] of FIG. 1*a*, with the with the grip deployed into a firing position and the telescoping muzzle device in a deployed position and with the magazine elevated such as after firing the two uppermost cartridges in its magazine.

The folding grip, which may also be called a pivotable shroud or skirt component, which is also called a folding grip, is shown in a deployed or ready to fire position. The folding grip may include grooved surfaces to improve the ability to grip and control weapon as indicated by the spaced apart series of finely dotted diagonal lines on one face of the grip.

The trigger assembly is connected to the frame and internal surfaces of the trigger and fire control components vertically advance a straight, bar-shaped magazine [30.] The magazine comprises a bar portion [31] having a linear array of chambers each having a bullet exit [34.] A breech flap [35] closes the rear ends of the chambers to retain spent cartridges within in the bar portion for easier collection and disposal or for reloading. Pulling the trigger [20] rearward and releasing operates internal, cooperating surfaces to cock a firing element and to release the element to fire an ammunition cartridge or "round" during a rearward trigger pull.

The collapsing and automatically deploying muzzle device [25] provides a number of benefits: it provides the benefits of a muzzle device such as a muzzle brake, compensator, and flash hider without any permanent overall length increase in the gun. It extends the sight radius, which is the distance between a front-mounted sight and a rear-mounted sight component. Longer sight radius enables more accurate aiming. The muzzle device in its extended position also protects against fingers getting in front of barrel, which is more likely with a very small gun, and it acts as a barrel or muzzle "guard." It enables mounting of accessories, shown as a phantom line box [X.] With an accessory, it acts a trigger guard when extended forward and away from the trigger as shown, so fingers may access and pull the trigger. The muzzle device spring [66] rides on one of the struts that support the muzzle device on the frame and bias the muzzle device in the extended position shown.

The angled slots [6] on the underside of the muzzle device acts as an accessory attachment rail system similar to a picatinny rail. The area below the muzzle device and designated [X] may be used to house a laser or flashlight. A selector switch may be used to toggle between four switched lighting modes: on, off, steady, and momentary, or between colors or spectra of emitted light. Another master off switch may be used to turn off all features when the safety is enabled by having the master switch press against the frame or trigger in the safe position. This way, whenever one or more of any of the safety features interdicting a trigger pull or preventing a hammer fall from striking a primer are disabled in preparation for firing, the preset features automatically turn on. Similarly, an interlock may be included that engages the hammer safety or trigger safety that disables one or both of these components unless the telescoping muzzle device is extended and deployed. It is important that enough space remains for the hand to grip the gun, and to shape the accessories so they not snag on clothing or inner lining fabrics of a concealment holster or a carry case.

In comparison, non-telescoping muzzle devices always extend the overall length of the firearm even while not in use, whereas the design disclosed herein does not waste the space consumed by an extended muzzle device when not being used. An array of upward apertures piecing from the vicinity of the barrel end may be tuned to act as a compensator deriving downward thrust from the propellant gases when the bullet exits the barrel. Similarly, by adding rearward rake angle to these or other apertures, the muzzle device may be fashioned to act as a muzzle brake. Also, in comportment with regulations for the manufacture and possession of suppressors (aka "silencers") baffle structures may be incorporated which closely approach the passage of the bullet through the muzzle device.

Figure 2B:
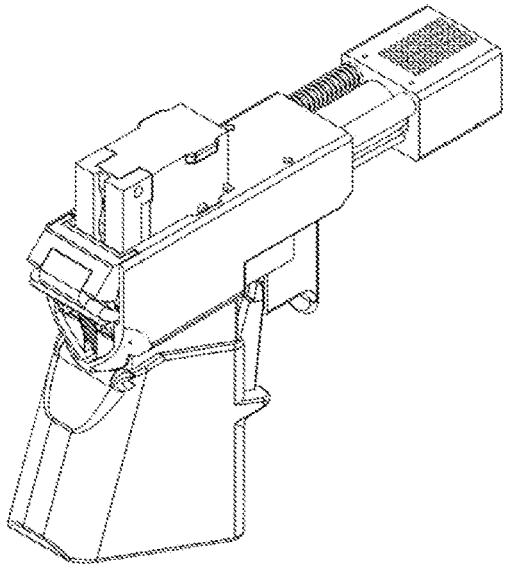
FIG. 2*b* shows an oblique, rear right top view of the pistol of FIG. 1*a* in the configuration of FIG. 2*a*.
Figure 2C:
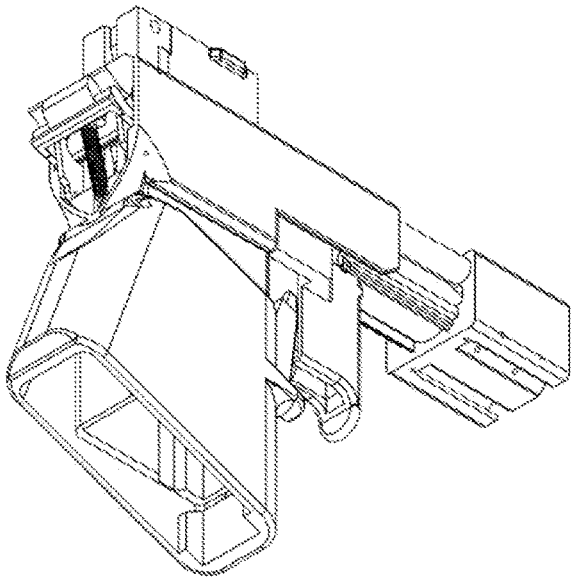
FIG. 2*c* shows an oblique, rear right bottom view of the pistol of FIG. 1*a* in the configuration of FIG. 2*a*.
Figure 2D:
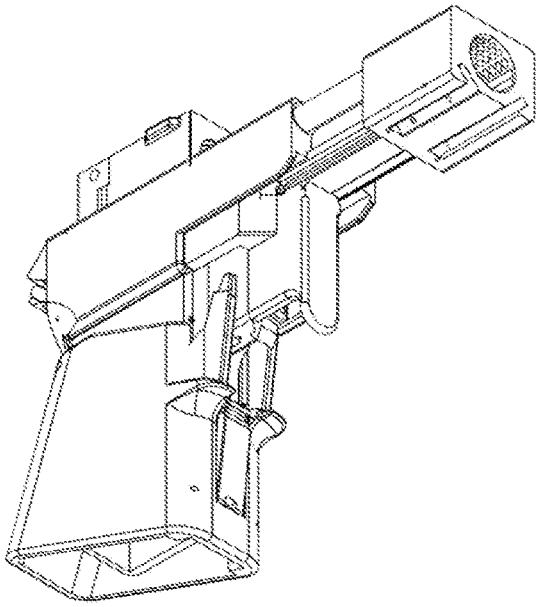
FIG. 2*d* shows an oblique, front right top view of the pistol of FIG. 1*a* in the configuration of FIG. 2*a*

FIG. 2*b* shows an oblique, rear right top view of the pistol of FIG. 1*a* in the configuration of FIG. 2*a*. FIG. 2*c* shows an oblique, rear right bottom view of the pistol of FIG. 1*a* in the configuration of FIG. 2*a*. FIG. 2*d* shows an oblique, front right top view of the pistol of FIG. 1*a* in the configuration of FIG. 2*a*.

Figure 3A:
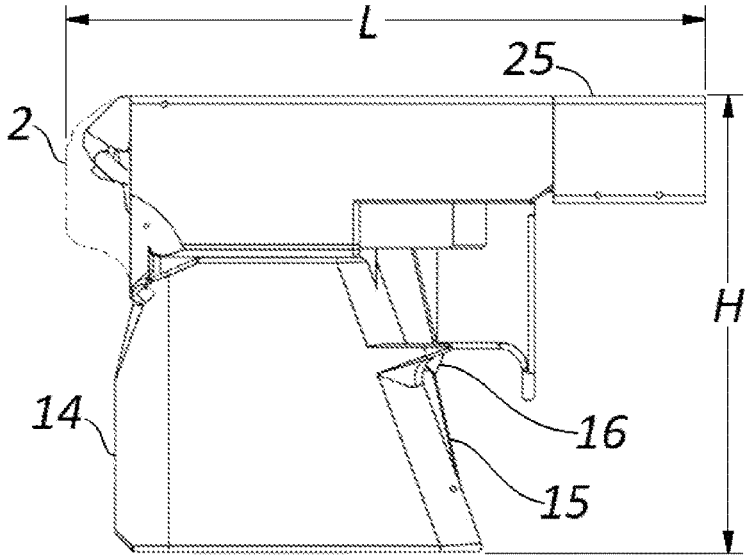
FIG. 3*a* shows a right side elevation view of the pistol of FIG. 1*a*.

FIG. 3*a* shows a right side elevation view of the pistol of FIG. 1*a*. This collapsed form is how the pistol would be stored in a pocket, purse, or holster, and this is the grip used to draw the firearm from the pocket or holster. The folding grip [14] is latched onto a hook feature [16] of the frame by a latch [15.] Squeezing the grip unsnaps the latch and pivots it into a ready to fire grip configuration sufficient for all fingers of the hand to participate in gripping and controlling the firearm. As will be explained below, internal prongs of the folding grip interfere with the fire control components and act as a safety such that the mechanism cannot cock and discharge a round while the folding grip is in the compact, concealment orientation shown in this figure. The prongs in this condition also latch the muzzle device [25] in its retracted state seen here. An optional rear cover [2] shown in phantom line may be added to the weapon to shroud and protect the exposed portions of the hammer and sear, leaving them less likely to catch on the internal surfaces of a fabric apparel pocket or holster, or to catch loose foreign objects in a purse. The length dimension [L] and height dimension [H] are depicted here for further discussion of the sizes of certain preferred embodiments of the invention.

Figure 3B:
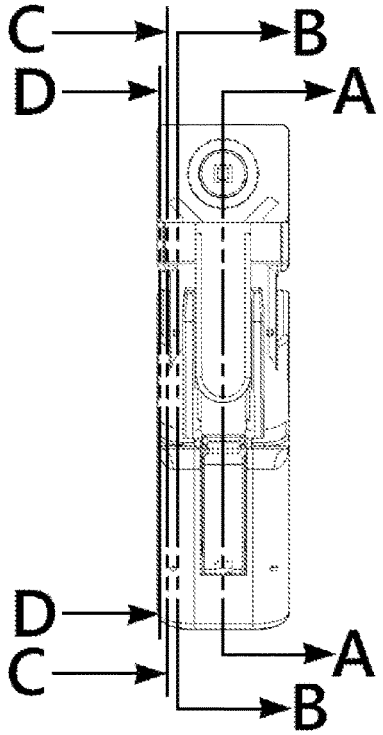
FIG. 3*b* shows a front view of the pistol of FIG. 1 and defines section line A-A for FIGS. 5*c*, 8*e*, 9*a*, and 10*a*, section line B-B for FIGS. 9*b*, 12*a*, 12*b*, and FIGS. 15*a* through 15*c*, section line C-C for FIGS. 11*a* through 11*e* and 14*d* through 14*f*, and section line D-D for FIGS. 9*c* and 9*d* and oblique section views of FIGS. 16*a* and 16*b*.
Figure 8A:
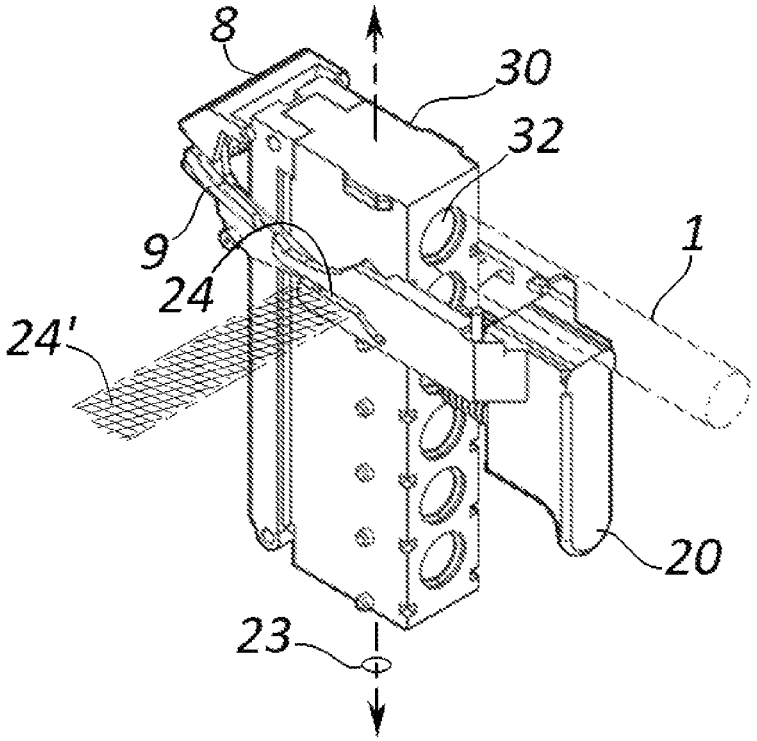
FIG. 8*a* shows an oblique, front right top view of a magazine assembly of FIG. 7*a* residing within the confines of some fire control components and a trigger in accordance with the invention.
Figure 8B:
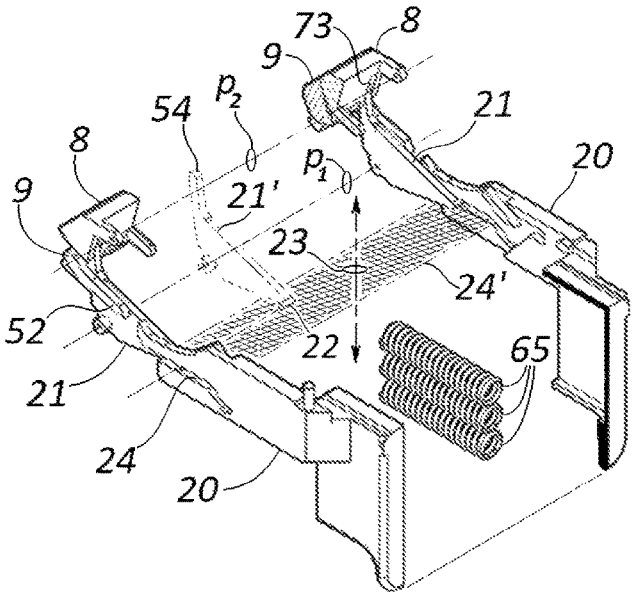
FIG. 8*b* shows an oblique, front top right view of exploded components of FIG. 8*a* split apart at section line A-A of FIG. 3*b*, and also an array of three trigger springs.
Figure 8C:
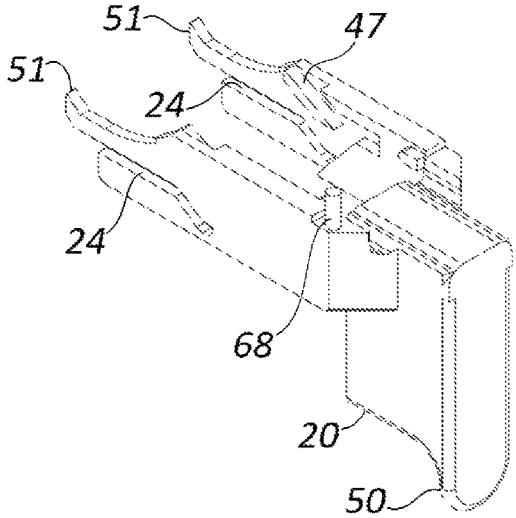
FIG. 8*c* shows an oblique, front right top view of an embodiment of a trigger component for a concealable pistol in accordance with the invention.
Figure 8D:
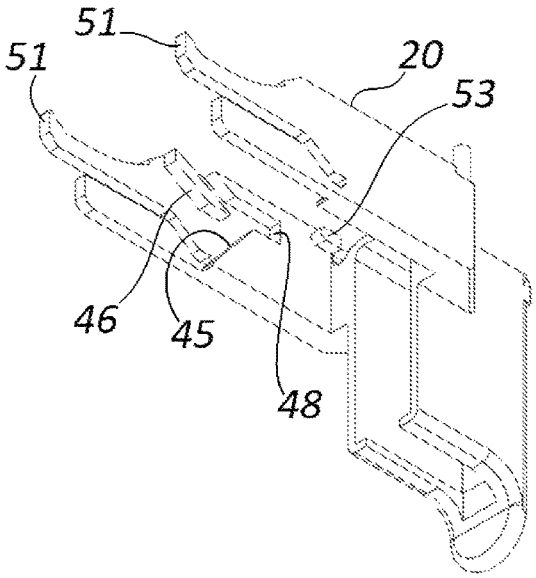
FIG. 8*d* shows an oblique, rear right bottom view of the trigger component of FIG. 8*c*.
Figure 8E:
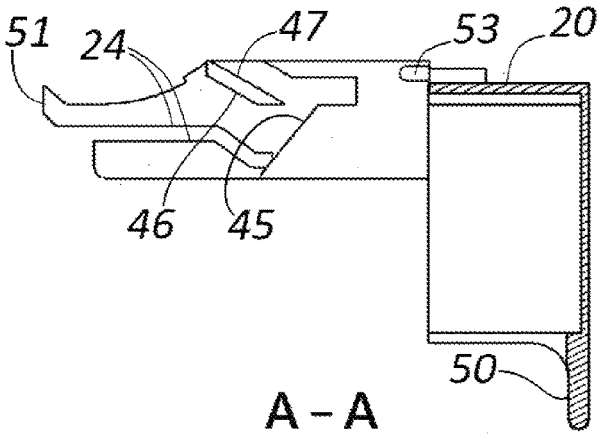
FIG. 8*e* shows a cross section view of the trigger component of FIG. 8*c*, taken at section line A-A of FIG. 3*b*.
Figure 9A:
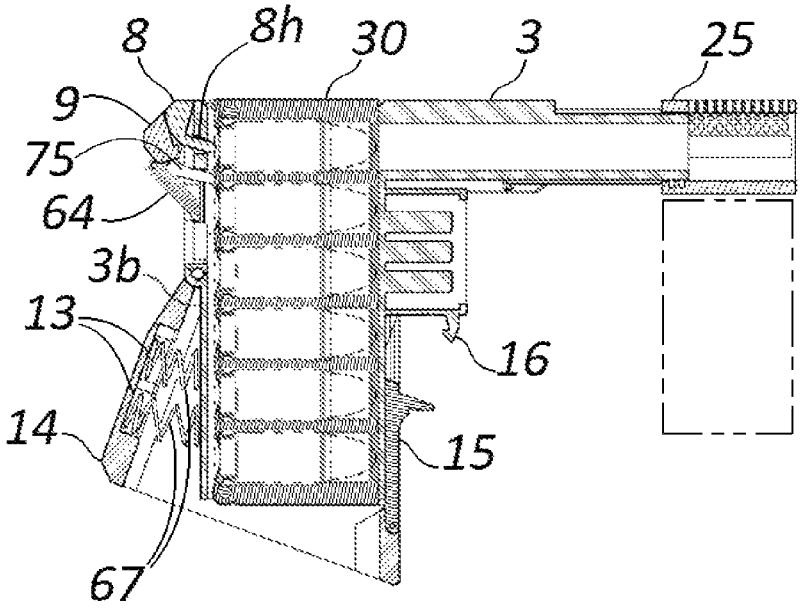
FIG. 9*a* shows a cross section view of the pistol of FIG. 1*a* taken at section line A-A of FIG. 3*b*, with its folding grip in a deployed position.
Figure 9B:
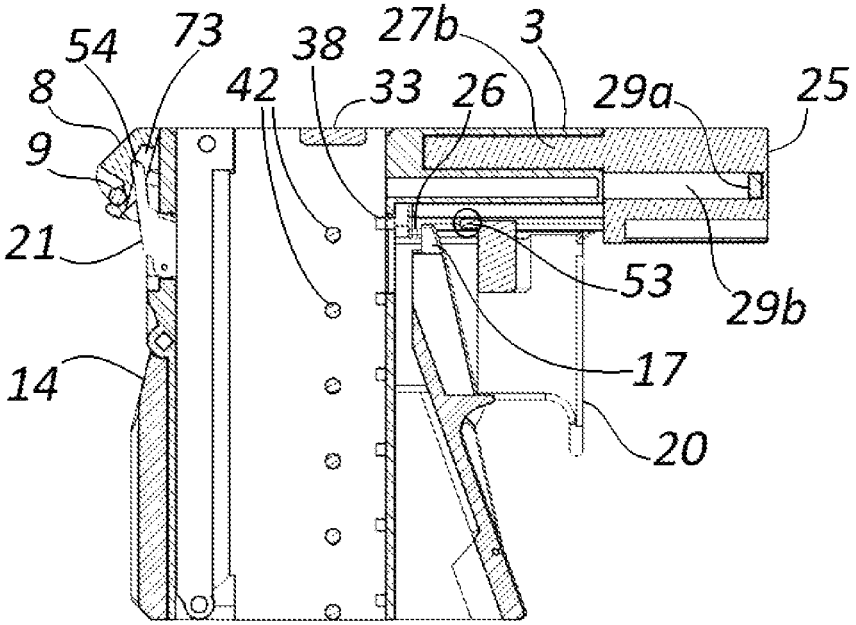
FIG. 9*b* shows a cross section view of the pistol of FIG. 1*a* taken at section line B-B of FIG. 3*b*, with its folding grip in a retracted and compact position.
Figure 9C:
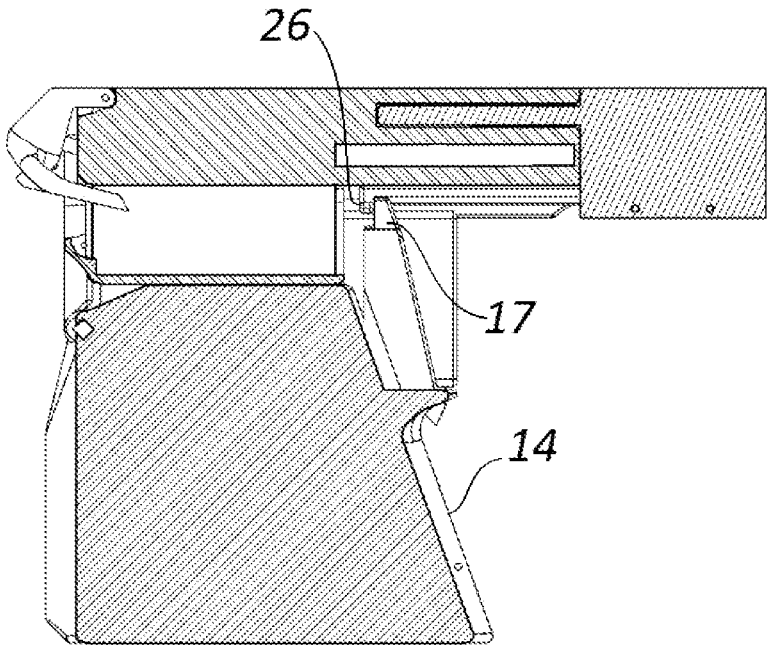
FIG. 9*c* shows a cross section view of the pistol of FIG. 1*a* taken at section line D-D of FIG. 3*b*, with its folding grip in a retracted and compact position.
Figure 9D:
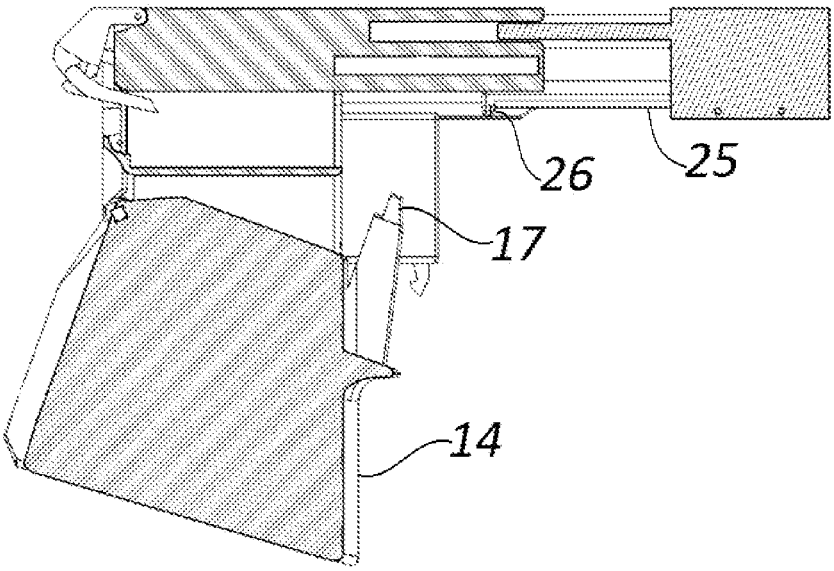
FIG. 9*d* shows a cross section view of the pistol of FIG. 1*a* taken at section line D-D of FIG. 3*b*, with its folding grip in a deployed position.
Figure 14D:
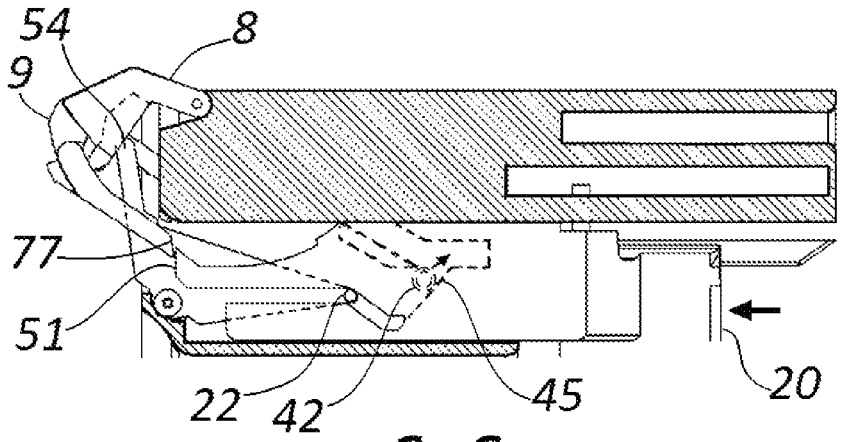
FIG. 14*d* shows a partial cross section view of the trigger, frame, and fire control components of the pistol of FIG. 14*a* taken at section line C-C of FIG. 3*b*, with the trigger being pulled from the second intermediate position to a third intermediate position with the sear approaching but not yet able to release the hammer to fall.
Figure 14E:
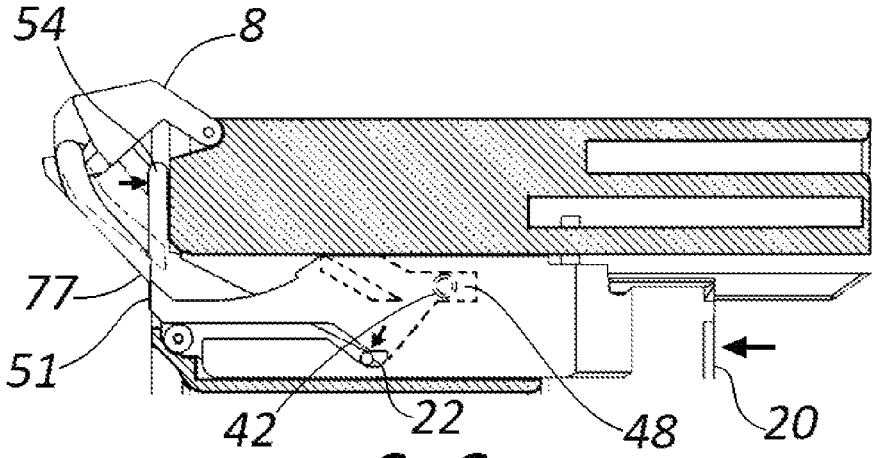
FIG. 14*e* shows a partial cross section view of the trigger, frame, and fire control components of the pistol of FIG. 14*a* taken at section line C-C of FIG. 3*b*, with the trigger being pulled from the third intermediate position to a fourth intermediate position with the sear at its release point for the hammer to fall.
Figure 14F:
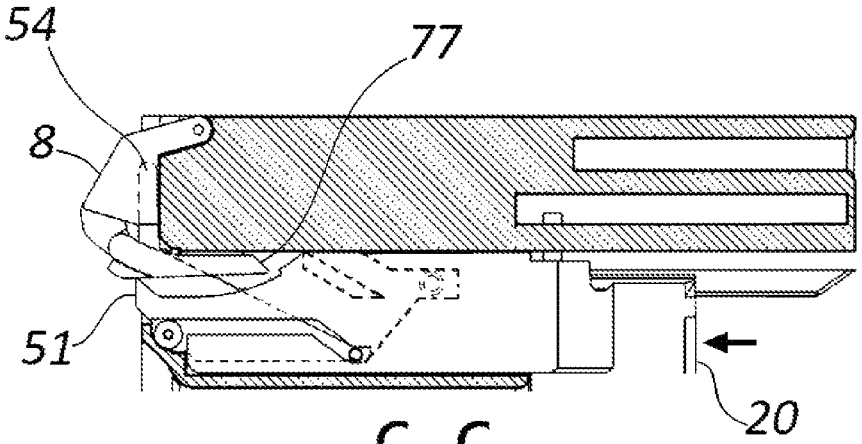
FIG. 14*f* shows a partial cross section view of the trigger, frame, and fire control components of the pistol of FIG. 14*a* taken at section line C-C of FIG. 3*b*, with the trigger being pulled from the fourth intermediate position to a fully retracted position with the sear having previously released the hammer to fall.
Figure 15A:
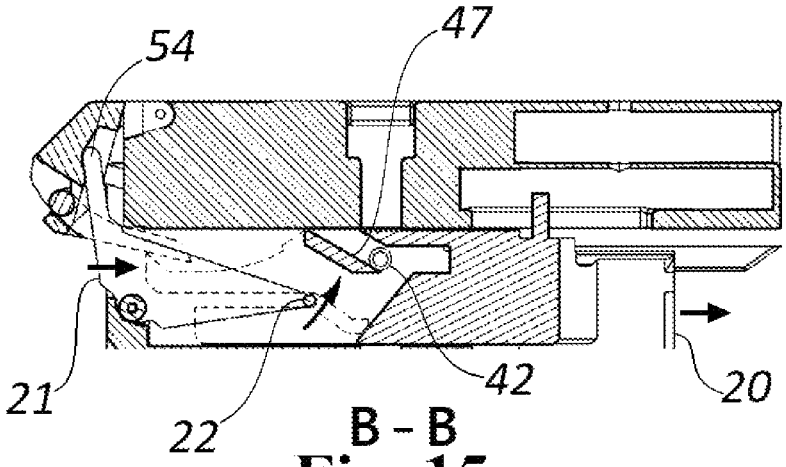
FIG. 15*a* shows a partial cross section view of the trigger, frame, and fire control components as seen in of FIG. 14*a* but taken at section line B-B of FIG. 3*b*, and with the trigger being partially released after shooting a cartridge in the uppermost chamber of the magazine.
Figure 15B:
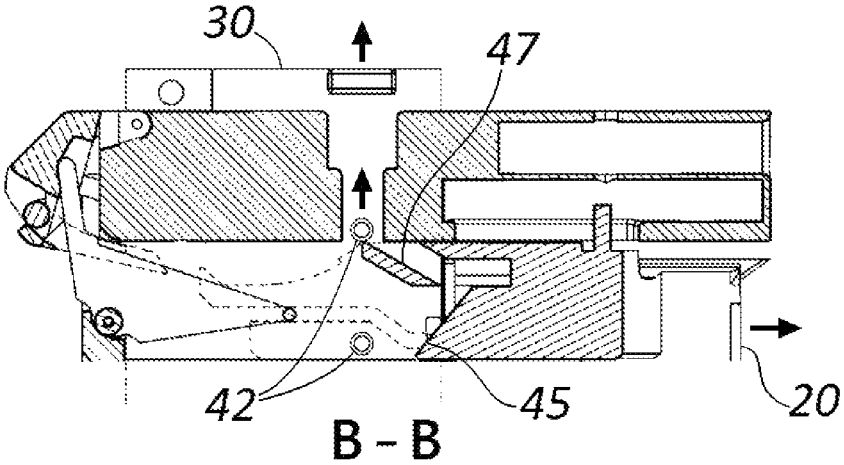
FIG. 15*b* shows the partial cross section view of the trigger, frame, and fire control components of FIG. 15*a*, taken at section line B-B of FIG. 3*b*, but with the trigger further released and at or near its resting, extended position.
Figure 15C:
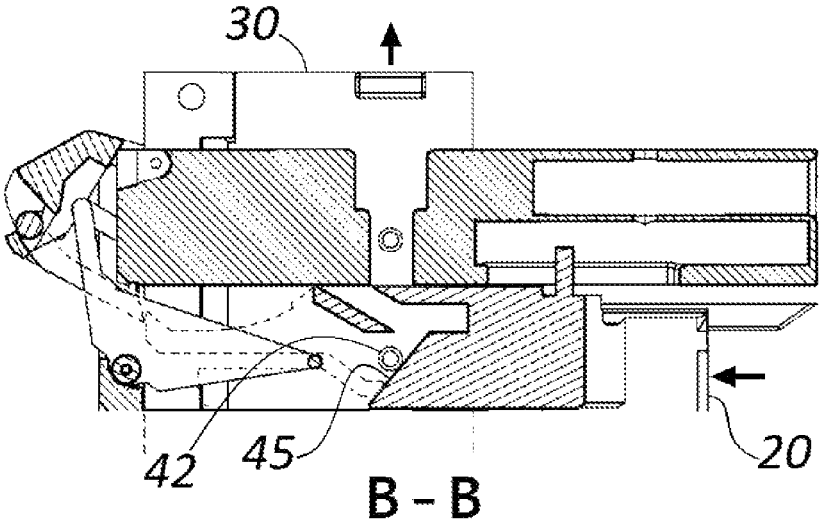
FIG. 15*c* shows the partial cross section view of the trigger, frame, and fire control components of FIG. 15*a*, taken at section line B-B of FIG. 3*b*, with the trigger partially pulled to begin a second shot.
Figure 16A:
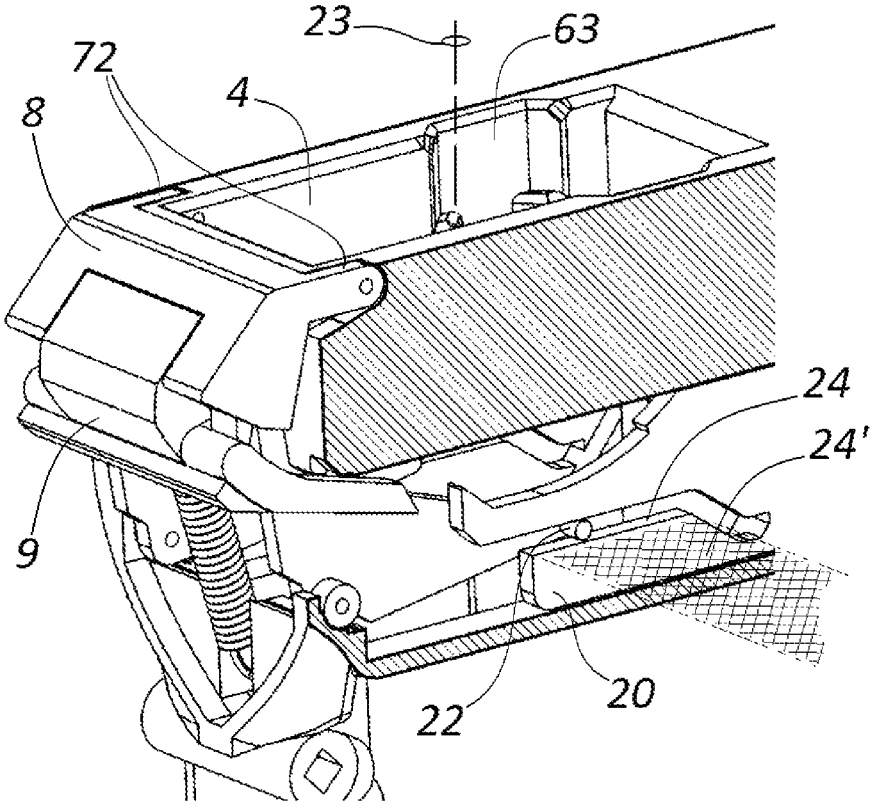
FIG. 16*a* shows an oblique, rear right top view or a partial cross section of the trigger and fire control components taken at cross section line D-D of FIG. 3*b*.
Figure 16B:
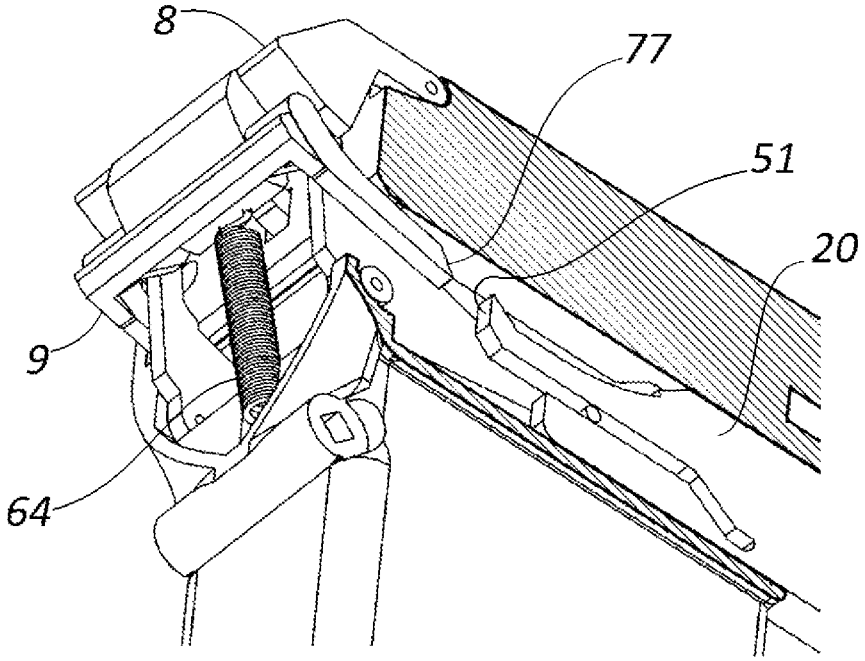
FIG. 16*b* shows an oblique, rear right bottom view of the fire control components of FIG. 16*a* taken at cross section line D-D of FIG. 3*b*.

FIG. 3*b* shows a front view of the pistol of FIG. 1 and defines section line A-A for FIGS. 5*c*, 8*e*, 9*a*, and 10*a*, section line B-B for FIGS. 9*b*, 12*a*, 12*b*, and FIGS. 15*a* through 15*c*, section line C-C for FIGS. 11*a* through 11*e* and 14*d* through 14*f*, and section line D-D for FIGS. 9*c* and 9*d* and oblique section views of FIGS. 16*a* and 16*b*.

Figure 3C:
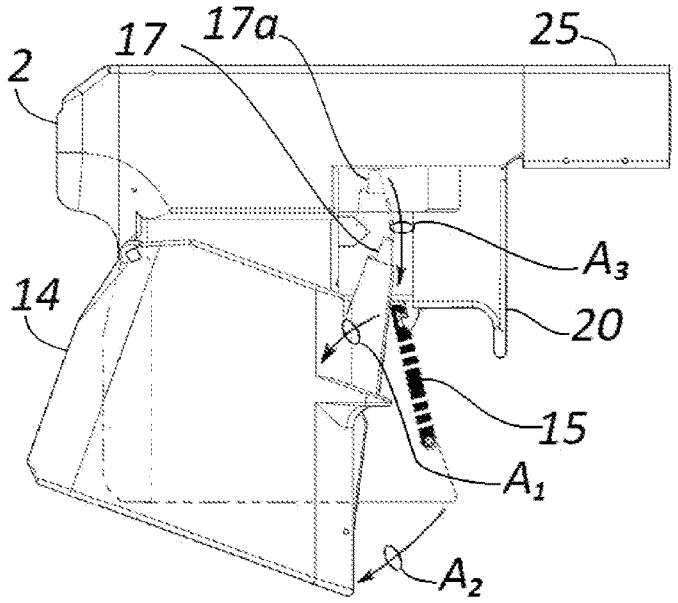
FIG. 3*c* shows a right side elevation view of the pistol of FIG. 1 with the folding grip shown in its deployed position, and with its compact, safe, and most concealable position shown in phantom line.

FIG. 3*c* shows a right side elevation view of the pistol of FIG. 1 with the folding grip shown in its deployed position, and with its compact, safe, and most concealable position shown in phantom line, and a cover [2] for the fire control components attached. While the firearm is being drawn, the safety is disabled by depressing the safety latch [15] located on the front of the grip with fingers of the drawing hand and even the pinkie or ring finger. Depressing the safety latch along pivot arc [$A_1$] causes the firearm to quickly transform into its extended form as the folding grip [14] pivots downwards along pivot arc [$A_2$] and the safety prongs [17] pivot along arc [$A_3$] out of their safety position shown in phantom line at [17*a*.] While latched in the safety position, the prongs interfere with attempts to pull the trigger [20] and also retain the telescoping muzzle device [25] in its retracted position shown. With the prongs withdrawn, the muzzle device becomes unlatched and extends by spring power, and the firearm is now ready to fire by means of a complete pull of the trigger.

The inventive concealable pistol uses a sliding trigger rather than a pivoting trigger. The sliding or translating trigger allows two fingers to pull the trigger, and for the index finger to find a purchase point close up beneath the barrel, enabling a higher and better grip on the gun. By approaching the line of action of the barrel and bore as closely as possible with the gripping hand, the length of the moment arm for the recoil force is minimized. The disclosed design also includes a folding and automatically deploying grip. With the small size of the gun, when the grip is folded there is only room for most users to apprise one or two fingers onto the grip. When the grip is deployed, space is gained for the one or two fingers that pull the trigger and for the other fingers of the hand to apprise the grip.

The folding grip also acts as a safety. The gun cannot fire with the grip folded, and whether the safety is on or off may be readily confirmed visually. The folding grip when deployed orients its front grip face vertically, which is still reasonably ergonomic, while the rear grip face is angled to fit the palm of the hand. When collapsed, the front grip face is oriented at a rake angle and the rear grip face is vertical, which makes the gun look less conspicuous.

Figure 3D:
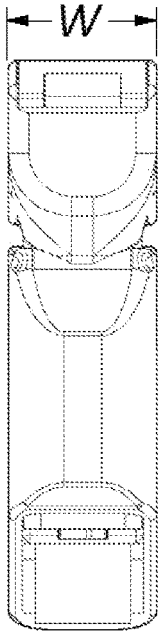
FIG. 3*d* shows a rear view of the pistol of FIG. 1*a*.

FIG. 3*d* shows a rear view of the pistol of FIG. 1 with a width dimension [W.] According to some preferable embodiments, the pistol may be configured to accept and operate with magazine assemblies holding 6 or 7 rounds of 9 mm Luger (9×19 mm) and with an overall barrel length of 3.5 inches. Yet with the safety enabled by means of the folding grip being tucked up, this sort of embodiment would be about the size of a regular man's wallet, or approximately 4.1" long [L of FIG. 3*a*,] by 3.0" high [H of FIG. 3*a*] by 0.94" wide [W] for 6 rounds of 9 mm Luger, and about 4.1"[L] by 3.5"[H] by 0.94"[W] for 7 rounds of 9 mm Luger. In comparison, the so-called "subcompact" Glock 43 has a slightly shorter barrel, but is significantly larger at approximately 6.3"[L] by 4.3"[H] by 1.06"[W] for 7 rounds of 9 mm Luger.

Figure 3E:
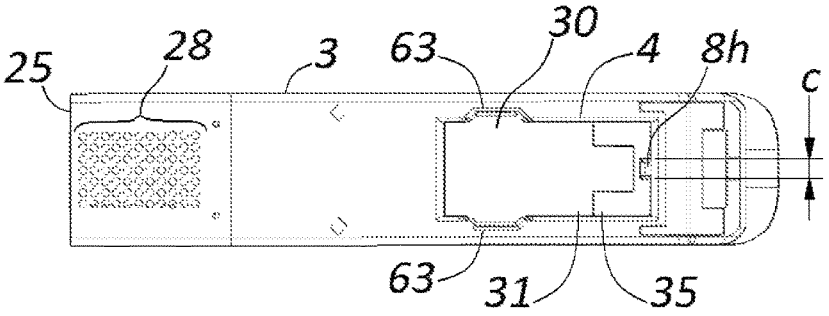
FIG. 3*e* shows a top view of the pistol of FIG. 1*a*.

FIG. 3*e* shows a top view of the pistol of FIG. 1, but with the barrel pointing leftwards in this view. The array of apertures [28] that act as a muzzle compensator in the muzzle device [25] are oriented vertically and appear as circles in this view. In other embodiments having apertures directed at an angle, such as partially aftwards to act as a muzzle brake, these apertures would appear as ellipses. The frame [3] includes a magazine well [4] which has a magazine assembly comprising a main cartridge block [31] and a breech flap [35.] The magazine well includes inward-facing grooves [63] which admit follower protrusions and insertion-stop wings which extend laterally from the side faces of the magazine body. The rear aspect of the breech flap includes a rearward facing channel shown by channel width dimension [c,] and the firing pin tip [8*h*] is seen protruding into the magazine well and residing within this channel.

Figure 3F:
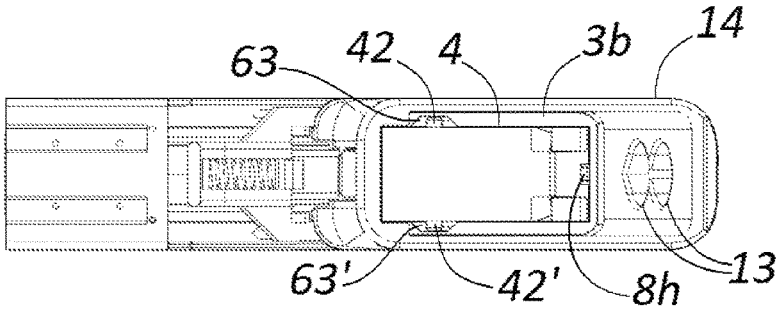
FIG. 3*f* shows a bottom view of the pistol of FIG. 1*a*.

FIG. 3*f* shows a bottom view of the pistol of FIG. 1, with the pistol barrel pointing to the left. Looking up from the underside of the grip body or magazine well body [3*b*] portion of the frame, an inserted magazine is seen in the magazine well [4] and pairs of magazine follower protuberances as seen in the magazine well grooves [63] and [63'] mutually face each other. The magazine follower protuberances are paired so that as to be discussed below engagement by the trigger component features of any follower protuberance [42] on one side of the magazine assembly is matched by complementary and symmetrically designed trigger component features engaging onto a symmetrically opposed protuberance [42'] on the opposite side of the magazine assembly. Looking up underneath the folding grip [14] in its deployed position as shown reveals one, two, or more cavities [13] which face in the direction of the rear surface of the grip portion or magazine well body. Also as was seen from above, the firing pin [8*h*] partially protrudes into the magazine well even during its "home" or "safe" condition and the rear groove in the magazine breech flap provides clearance for the magazine to translate within the well without contacting the hammer tip.

Figure 4A:
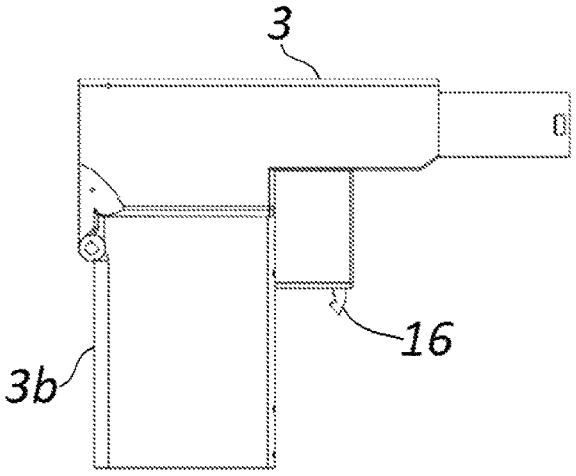
FIG. 4*a* shows a right side elevation view of an embodiment of a frame component for a concealable pistol in accordance with the invention.

FIG. 4*a* shows a right side elevation view of an embodiment of a frame component [3] for a concealable pistol in accordance with the invention, grip body or magazine well portion [3*b*] and a hook feature [16] onto which a complementary latch or hooked strap may attach to retain the folding grip in a compact, stored state.

Figure 4B:
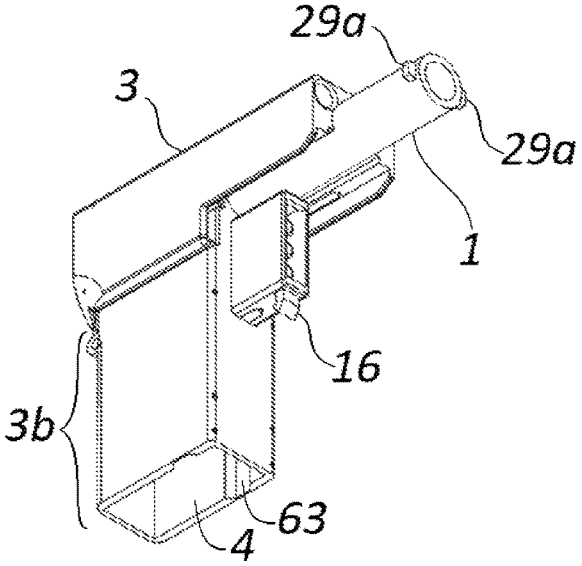
FIG. 4*b* shows an oblique, front right bottom view of the frame component of FIG. 4*a*.

FIG. 4*b* shows an oblique, front right bottom view of the frame component of FIG. 4*a*. The frame [3] includes a lower magazine well body portion which defines a magazine well opening [4] which passes through the top surface of the frame. The magazine well includes vertical grooves [63] which run the length of the well but have a change in width seen and explained in other views. Two muzzle guide studs [29*a*] emerge laterally from the barrel [1] near its muzzle end. The barrel may be made as an integral portion of the frame or may be a separable piece such as by providing threads at the chamber end and the frame providing complementary threads as a receiver component. Such a configuration would allow the same frame, trigger, hammer, sear, transfer bar safety, and grip kit to operate in more than one caliber by providing magazines chambered to different calibers and a threaded barrel for each caliber. A single frame may be designed to accept magazines and barrels for a plurality of closely sized ammunition such as the set consisting of 9 mm×19 Luger, 0.357 Sig, 0.40 S&W, and possibly including 9 mm×23 Winchester. A weapon made to a duty caliber may be furnished with a subcaliber magazine and barrel kit chambered for 0.22 LR for training to reduce flinch or for economical target practice.

The magazine well body portion [3*b*] includes trigger guide features which form a box that shrouds one or more rods for locating and stabilizing the main trigger spring or springs and preventing Euler buckling of the springs during compression of a trigger pull. A hook feature [16] protrudes below the trigger spring shroud box for latching and retaining the pivotable folding grip (not shown) in a concealable storage or "safe" carry condition.

Figure 4C:
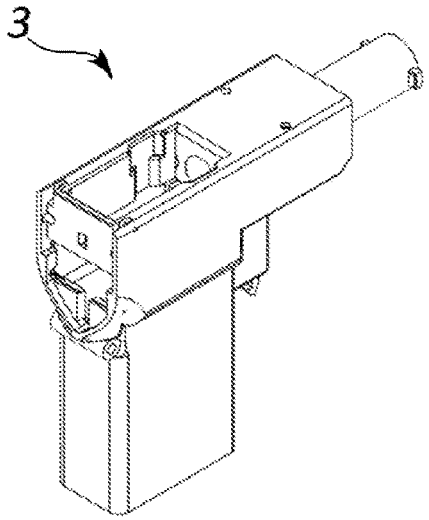
FIG. 4*c* shows an oblique, rear right top view the frame component of FIG. 4*a*.
Figure 4D:
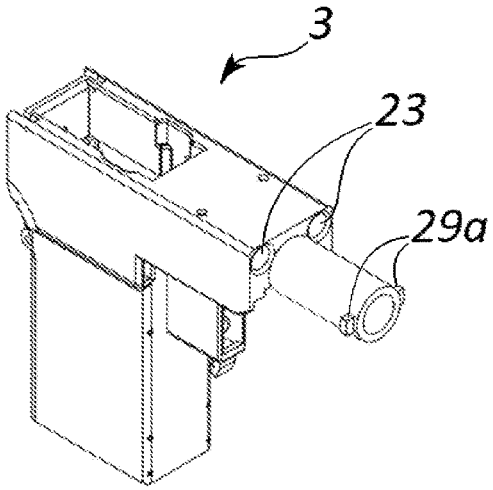
FIG. 4*d* shows an oblique, front right top view of the frame component of FIG. 4*a*.

FIG. 4*c* shows an oblique, rear right top view the frame component [3] of FIG. 4*a*. FIG. 4*d* shows an oblique, front right top view of the frame component [3] of FIG. 4*a*. Two longitudinal apertures [23] extend rearwardly into the frame material where the barrel meets the main or receiver portion of the pistol. These apertures house the guide studs of the muzzle device and at least one aperture also houses an extension spring that extends the magazine from its compact and retracted storage position to its extended or ready position. Two muzzle guide studs [29*a*] emerge laterally from the barrel near its muzzle end.

Figure 5A:
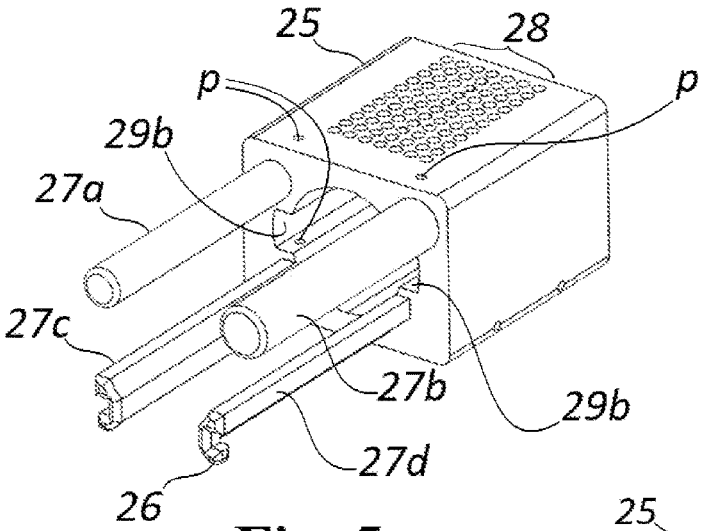
FIG. 5*a* shows an oblique, rear right top view of an extendable muzzle component for a concealable pistol in accordance with the invention.

FIG. 5*a* shows an oblique, rear right top view of an extendable muzzle component [25] for a concealable pistol in accordance with the invention. This component is a telescoping muzzle device that slides longitudinally forward and backward along the barrel, with spring pressure pushing it forward towards its extended position. It is guided linearly by the barrel and lugs or muzzle guide studs ([29*b*] in FIGS. 4*c* and 4*d*) on the barrel cooperating with inward-facing grooves [29*b*] of the muzzle device and also by guide rods [27*a*, 27*b*] being received within the apertures ([23] of FIG. 4*d*) of the frame. Additional longitudinal guidance is effected by two more longitudinal beams [27*c*] and [27*d*] which include laterally outward facing grooves which act as mortises that interoperate with tenon features elsewhere in the frame component.

The muzzle device acts as a heat shield that prevents fingers from touching a hot barrel. The larger guide rod [27*b*] slides in one of the longitudinal apertures in the frame and the thinner guide rod [27*a*] is received in the other aperture with enough space to include a helical coil spring riding outside the rod and within the aperture. The sectional depth of one of the longitudinal beams ([27*d*]) is trimmed except at its tip so that the remaining material there acts as a hook [26] or latch feature. Such a hook may also be formed at the tip of the other beam as well, and may also have spring-loaded catches, so the muzzle device may be retracted while the folding grip is retracted in the safe position. As shown here, the hooks would simply abut the grip fingers if the safety is already enabled. The array of compensator apertures [28] is also visible in the top surface of the muzzle device. Apertures [p] accept slender pins (not shown) which trap the muzzle device onto the barrel end when installed after sliding the muzzle device onto the barrel with its muzzle guide studs ([29*a*] seen in FIGS. 4*b* and 4*d*) inserted deeper along the grooves [29*b*] than these apertures. While retracted, the prongs ([17 and [17*a*] of FIG. 3*c*) of the folding grip catch the hooks of the longitudinal beams of the muzzle device.

Figure 5B:
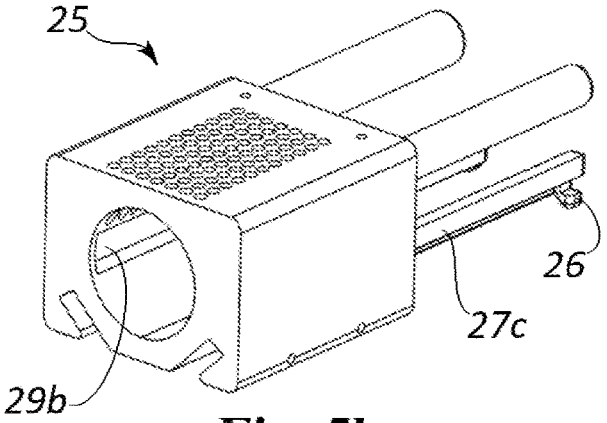
FIG. 5*b* shows an oblique, front left top view of the extendable muzzle component of FIG. 5*a*.

FIG. 5*b* shows an oblique, front left top view of the extendable muzzle component [25] of FIG. 5*a*. The muzzle device has inward-facing grooves [29*b*] which are closed near its front face. In this view the sectional depth of longitudinal beam [27*c*] is trimmed except at its tip so that the remaining material there acts as another hook [26] or latch feature complementary to latch feature [26] of longitudinal beam [27*d*] seen in FIG. 5*a*.

Figure 5C:
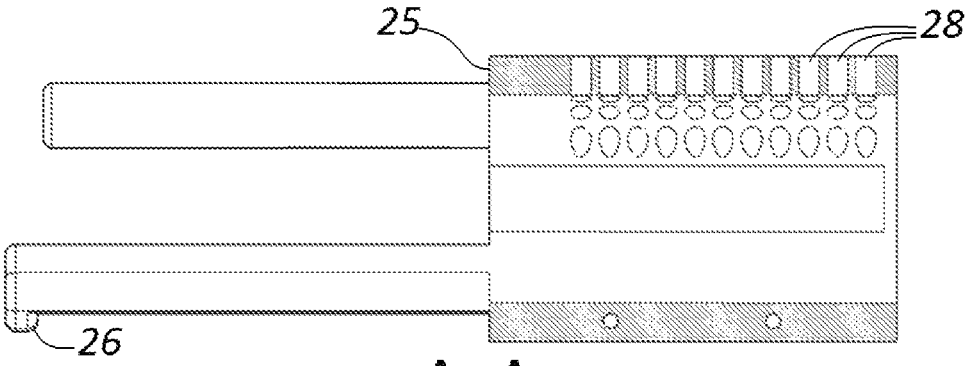
FIG. 5*c* shows a cross section view of the extendable muzzle component of FIG. 5*a* taken at section line A-A of FIG. 3*b*.

FIG. 5*c* shows a cross section view of the extendable muzzle component of FIG. 5*a* taken at section line A-A of FIG. 3*b*. When extended ahead of the muzzle end of the barrel, this component [25] provides benefits of both a flash hider and a compensator. In an alternate embodiment within the scope of the invention, the apertures [28] may be angled aftwards to act as a muzzle brake. The expanding gasses are guided through the apertures away from the shooter's fingers. In yet another alternate embodiment within the scope of the invention, the muzzle device may be fashioned as a simple sleeve with blind interior cavities rather than through holes, or other sorts of baffle structures closely sized to the bullet diameter, then the device may function as and be legally considered a suppressor, and be heavily regulated in many jurisdictions.

Figure 6A:
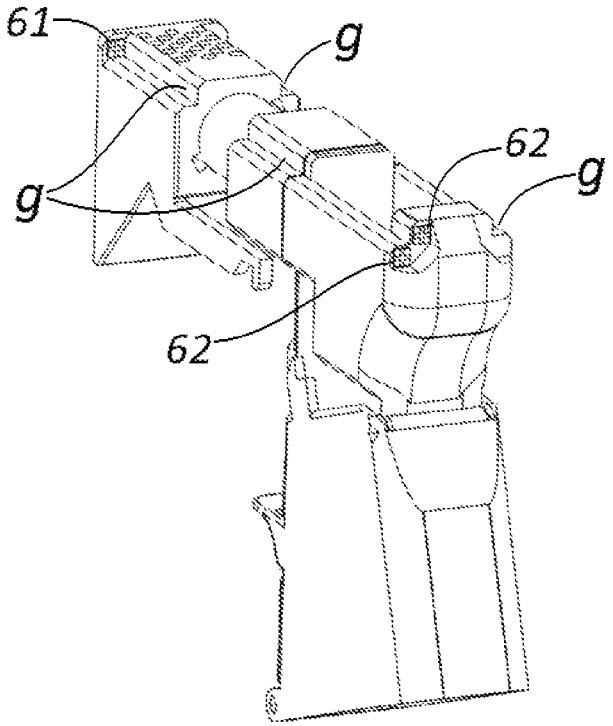
FIG. 6*a* shows an oblique, rear left top view of an alternative embodiment of a concealable pistol in accordance with the invention having a sight configuration and an alternative embodiment of an extendable muzzle.

FIG. 6*a* shows an oblique, rear left top view of an alternative embodiment of a concealable pistol in accordance with the invention having a sight configuration and an alternative embodiment of an extendable muzzle. The frame and muzzle device include gutters [g] along their top edges, and the forward end of the muzzle device end has a front sight [61.] Besides the cross shown here, which is preferably colored in contrasting colors to bring out the cross in relief against the background field, other embodiments for front and rear sights [62] within the scope of the invention include a simple circle, multiple concentric circles, luminous or phosphorescent materials such as low-energy tritium used in Trijicon® sights, and fiber optics may also be used. By extending the muzzle device, the effective barrel length is increased which increases the sight radius, which provides for more accurate shooting.

Figure 6B:
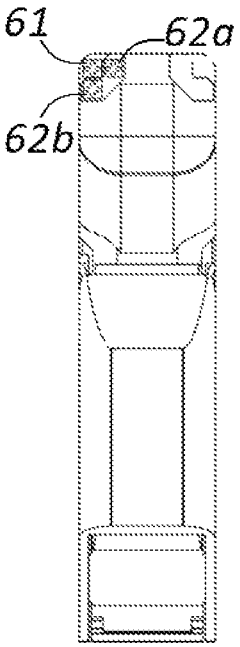
FIG. 6*b* shows a rear view of the pistol of FIG. 6*a* with its sights aligned.

FIG. 6*b* shows a rear view of the pistol of FIG. 6*a* with its front sight [61] aligned with the two rear sights. As opposed to three components aligned horizontally, such as the left horn of a rear sight, the front sight, and the right horn of the rear sight in traditional "iron sights," the twin "gutter" sight system optimizes the visual references within the space available, so the three components of the sights make a 90° angle in which the front sight registers with a first rear sight component [62*a*] to provide an elevation reference for the orientation of the barrel in its environment, and the second rear sight component [62*a*] provides an windage or azimuth reference for the same.

Figure 7A:
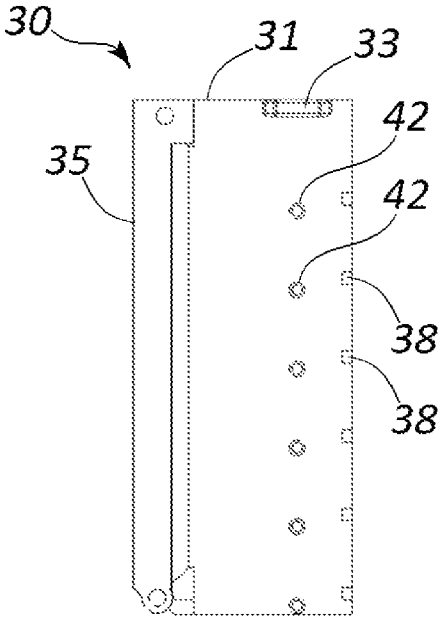
FIG. 7*a* shows a right side view of a magazine assembly for a concealable pistol in accordance with the invention.

FIG. 7*a* shows a right side view of a magazine assembly [30] for a concealable pistol in accordance with the invention. Two sets of features on the magazine block [31] are used to advance the magazine from one chamber to the next while repeatedly cycling through trigger pulls and releases. The first of these are a vertical array of follower protrusions [42] or lifting studs which project laterally from the side face of the magazine. The second of these are forward facing notches [38] into which the trigger inserts an alignment pin which confirms alignment of a magazine chamber with the barrel held in the frame. The follower protrusions pass through a groove in the frame of a first, narrower width throughout the magazine well, which widens near the top of the frame to accept a wider "wing" protrusion [33] at or near the top of the magazine block. The wider portion of the groove accepts the wing protrusion but stops it at a shelf or constriction of the width of the groove partway in, near the top of the magazine well. The constriction of the width of the groove forms an over-insertion stop which holds the uppermost or first round in a "safe" position close to but out of alignment with the barrel. The wing element being shaped differently from the other protrusions and located near end of the magazine block helps identify by touch which end of the magazine is to be inserted into the well. A user familiar with the equipment would be able to grab a loaded magazine, locate the wing tab, and orient the magazine for proper insertion into the magazine well in the dark or without looking at the components.

After loading, the breech end of the chambers are closed up by swinging a breech flap to close against the rear surface of the magazine. A pivot pin may be located at either the top or bottom end of the magazine, and the opposite end would include a clasp, hasp, or latch as means to lock the breech flap shut and trap the cartridges within their chambers of the magazine block. The cartridges or "brass" are not expelled during sequential firing of the magazine.

Figure 7B:
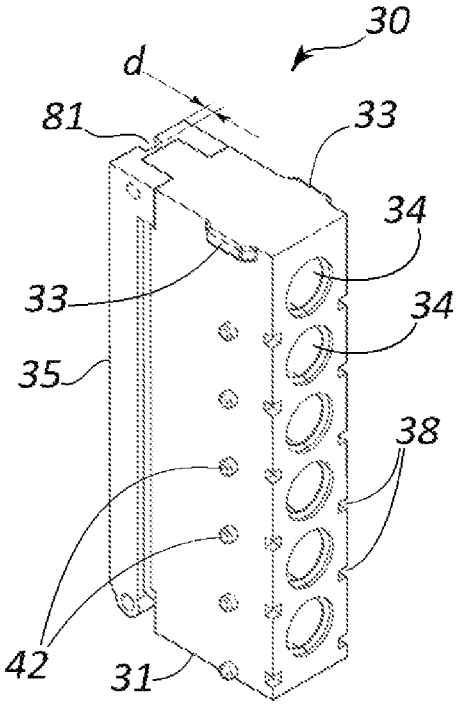
FIG. 7*b* shows an oblique, front right top view of the magazine assembly of FIG. 7*a*.

FIG. 7*b* shows an oblique, front right top view of the magazine assembly of FIG. 7*a*. Instead of a revolver with cylinders arranged in a circular pattern, this design arranges cylinders in a linear array. The magazine [30] is stored in the magazine well of the frame, and indexes upwards to shoot. The magazine may be quickly removed and exchanged for a pre-loaded magazine, allowing for quick reloads. The magazine interacts with the frame while contained within the magazine well in the frame. The magazine is inserted from the top, and has wings [33] that prevent over-insertion. Unlike most other semi-automatic pistols, the magazine is not inserted into the bottom of the magazine well or the bottom of the grip portion of a frame. The magazine assembly includes a core or block [31] defining a plurality of chambers each configured to contain an ammunition cartridge and each having a bullet exit [34.]

The magazine interacts with the trigger, which uses angled surfaces to lift the magazine from an initially depressed position within the magazine well. A vertical array of follower protrusions [42] or lifting studs project laterally from the side face of the magazine block. The block also includes forward facing notches [38] into which the trigger inserts an alignment pin to confirm alignment of a magazine chamber with the barrel held in the frame. In preferable embodiments the lateral projections and wings are symmetrically matched by complementary sets of features on the opposite side of the magazine block, and the forward facing notches are arranged in symmetric pairs registered to each bullet exit.

The magazine assembly comprises a breech flap [35] which keeps the rounds locked in place. The breech flap, or breech cover, pivots on a pin preferably located at the bottom of the magazine. To insert cartridges into the magazine, the breech flap is pivoted open. In some embodiments a second pin at the top of the magazine block has to be removed to allow the breech flap it to pivot. Alternatively, a set of hooks or opposed latches may be used on the top of the magazine that grab onto the breech flap and secure it when the breech is closed, by which the user pinches the hooks or latches to release the flap. Other magazine closures that reside within the scope of the invention include locking mechanisms such as a captive cross-pin and spring-loaded clips that grab onto the breech flap when the flap is closed, so that to open the breech flap, the clips are manually pinched to release the flap. To reload the magazine, the breech flap is unlocked and swung open, and spent cases may be swapped for new rounds. Reloading this type of magazine may be accomplished about as quickly as reloading a semi-auto magazine and is much faster than reloading a revolver.

A benefit of the pivoting back-door design is that the magazine cannot be inserted into the magazine well unless the breech flap is properly closed because if the breech flap is less than completely closed, it presents a combined length with the magazine block that is longer than the length of the magazine well opening and so is blocked from insertion. The magazine breech flap includes a rearward opening groove or "trench" [81] indicated by depth dimension [d.] The back-door design also reduces the likelihood of injury to the shooter in the case of a hangfire while the cartridge that was struck by the primer gets indexed outside of the frame. This would occurs when a well-trained shooter in a combat situation detects that a round was struck by the firing pin but did not discharge into the barrel is a "dud" and the shooter will cycle the action to fire the next round to continue prosecuting the threat.

With conventional semi-automatic pistols, combat shooters are trained to "slap-rack" rapidly and stay in the fight. The "slap-rack" action is to slap the bottom of the magazine in its well to re-confirm its proper engagement with the pistol action, and then "rack" the slide to eject the failed round and load the next round in the chamber. The suspicious "dud" round is expelled randomly and might discharge unsupported ("cook off") at any time, which is hazardous in a practice range activity but adds an unexpected random element under a stress fire situation—where did the "dud" round end up, and is the shooter at risk of injury if it cooks off at any moment? With the disclosed invention, the "dud"

round remains trapped in the magazine and pointed downrange. While grip discipline is prudent to keep the shooter's hands clear of a later discharge of the "dud" round, since only the primer is exposed to the shooter's face, the likelihood of injury to the face by deflagration fragments is substantially mitigated. The rest of the cartridge case is safely contained within the magazine. In alternative embodiments within the scope of the invention, each chamber of the magazine block is provided with an individual rear clip or door which is installed and secured as each round is loaded into each magazine chamber. In other embodiments the pivot axis of the rear breech flap is longitudinal to the magazine block (i.e, vertical in this figure,) and resides proximate to a rear longitudinal edge of the magazine block, such as by incorporating a longitudinal hinge pin. Also, although in the embodiment shown is configured as a six-round magazine, longer magazines may be produced for larger ammunition capacity with the additional length and chambers protruding out the bottom of the grip and magazine well when the uppermost round is registered with the barrel.

Figure 7C:
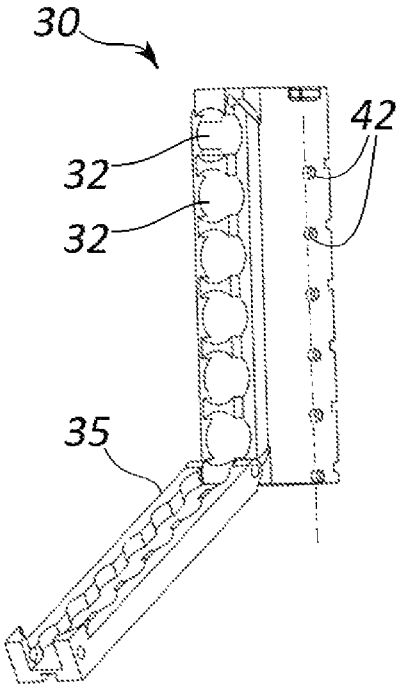
FIG. 7*c* shows an oblique, rear left view of the magazine assembly of FIG. 7*a* with its breech flap component swung open for inspection and loading.

FIG. 7*c* shows an oblique, rear left view of the magazine assembly [30] of FIG. 7*a* with its breech flap component [35] swung open for inspection and loading. The magazine has a plurality of follower elements [42] with each of the follower elements associated with a chamber [32,] and the follower elements are arranged in a line parallel to the length of the magazine. For convenience an exemplary line is shown as a dash and long dash line. In other compact designs fired chambers are moved out of the gun so that the back of the ammunition casing may point towards the shooter's face. A hangfire in such a condition would be like an exploding mini grenade in the shooters face. In contrast, the disclosed design in its various embodiments includes a "breech flap" that closes behind the chambers. Even for a hangfire cartridge that gets indexed outside of the gun's frame, the robust side rails of the breech flap would contain the round safely and long for pressure to expel the bullet in a direction away from the shooter and relieve the chamber pressure. Thus the disclosed embodiments for a magazine in accordance with the invention provide safety to a shooter even in the event of an out-of-battery detonation of a cartridge.

Figure 7D:
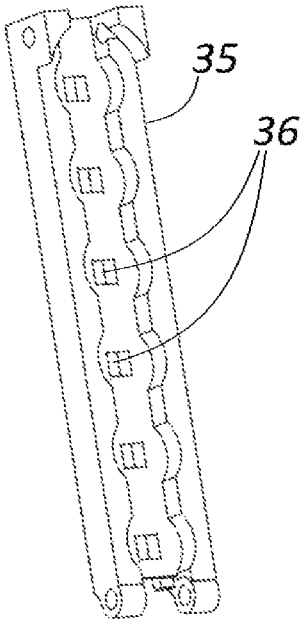
FIG. 7*d* shows an oblique, front, right bottom view of a breech flap for the magazine assembly of FIG. 7*a*.

FIG. 7*d* shows an oblique, front, right bottom view of a breech flap [35] for the magazine assembly of FIG. 7*a*. The breech flap includes windows [36] registered with each chamber so that the primer of a cartridge aligns with the window registered with the chamber holding the cartridge. The hammer firing pin tip resides in a rear groove of the magazine (a feature of the breech flap seen in FIGS. 3*e*, 3*f*, and 7*b*) but the pin only enters a window to strike the primer of the cartridge registered with the barrel axis. Entry of the pin is not permitted except when a transfer bar safety moves from a blocking condition to an operation condition in response to actuation of the trigger assembly.

Figure 7E:
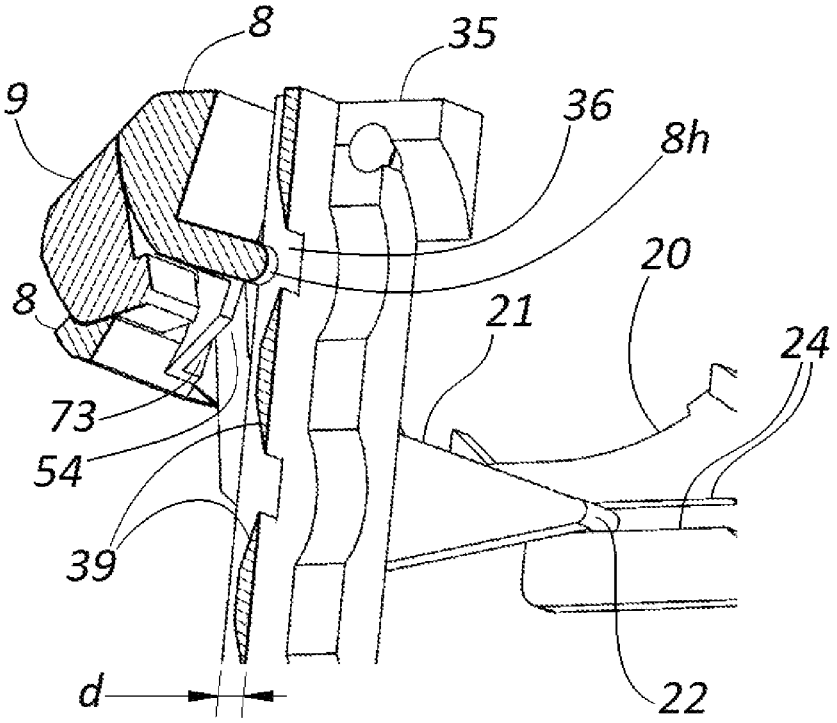
FIG. 7*e* shows an oblique cross section view of some fire control components, a portion of a trigger, and a portion of a breech flap, taken at section line A-A of FIG. 3*b*.

FIG. 7*e* shows an oblique cross section view of some fire control components, a portion of a trigger [20,] and a portion of a breech flap [35] taken at section line A-A of FIG. 3*b*. Unlike conventional revolvers and many conventional semi-automatic pistols, the hammer [8] swings downward towards the primer. The firing pin [8*h*] is visible, and it strikes the primer to fire a round in the magazine chamber directly ahead of the window [36] into which it enters. In the configuration shown, a pin [22] or follower element of the transfer bar safety [21] is engaged by at least one contact surface [24] of the trigger. The transfer bar safety pivots like a bell crank, with the pin at the end of one leg and the other leg being a blocking bar [54] which resides within a slot [73] in the hammer. With the guide surfaces of the trigger holding the pin as shown in this figure, the tip of the blocking bar leans aft of the frame and stops the hammer from inserting its firing pin into a chamber of the magazine.

The hammer and sear [9] are temporarily conjoined as a single mass in this configuration, and the firing pin portion of the hammer protrudes into the magazine well even when held by the transfer bar safety. The rear channel of the magazine breech flap includes a rearward facing channel of a depth [d] greater than the protrusion of the firing pin tip when the hammer is blocked by the blocking bar. However, if this safety interlink were to somehow fail, the firing pin would remain biased forward by the hammer spring (shown elsewhere.) If a loaded magazine is evacuated quickly, sliding the magazine out of the well would cause the hammer to pop in and out of the linear series of primer windows in the breach flap. To reduce the chance that an energetically falling hammer would strike upon and initiate a primer as a primer window slides past, ramps [39] in the channel adjacent to the windows would slow the pivoting motion of the hammer so that its tip would ride gently onto a primer surface, rather than quickly dropping the hammer. These ramps also prevent the firing pin, even if it were to enter a breech flap window, from locking the magazine in place because the ramps are angled so that they extract the firing pin from the window when the magazine is pulled out.

FIG. 8*a* shows an oblique, front right top view of a magazine assembly [30] of FIG. 7*a* residing within the confines of some fire control components and a trigger in accordance with the invention. The fire control components shown in this figure include the hammer [8] and sear [9.] The trigger [20] assembly is operably connected to the magazine to index the magazine along its length in the direction [23] defined by the length (i.e, a longitudinal extension) of magazine the well and shown as a heavy dash and long dash line. The trigger includes guiding and camming surfaces wherein some engage with the lateral protrusions of the magazine block and others form a slot that engages with a pin at one end of the transfer bar safety. One such contact surface [24] is extended with a cross hatch plane [24'] to show that it is a contact surface is perpendicular to the length of the magazine well. With the magazine having a fully loaded condition, an uppermost chamber [32] is registered with the barrel [1] shown in phantom line, and the trigger assembly is operable to discharge a cartridge in the uppermost chamber.

FIG. 8*b* shows an oblique, front top right view of exploded components of FIG. 8*a* split apart at section line A-A of FIG. 3*b*, and also an array of three trigger springs [65.] The transfer bar safeties, which for safety by redundancy two are provided symmetrically and laterally spaced apart in the frame, are operably interconnected with the trigger assembly [20.] The transfer bar safety [21] is pivotally connected to the frame. Since they operate in tandem, the two shown here may optionally be combined into one part by extending a transverse pivot axle to connect and unify them. The transfer bar safety attaches to the frame for rotation and pivots around its round boss feature about pivot axis [$p_1$.] The transfer bar safety has a horizontal or lateral protrusion [22] with a round lug on one side of its pivot point that interacts with the transfer bar safety guide channel of the trigger. The lug is seen on an additional instance of the transfer bar safety [21'] shown in phantom line. Opposite from the pivot point of the transfer bar safety is its blocking bar [54] which in plurality reside within slots [73] of the hammer [8.] The guide channel has a zig-zag at the end of a straight section. While the lug resides in the straight section, the transfer bar safety is maintained in a position wherein the blocking bar is tipped aft and prevents the hammer from pivoting forward completely. One of the contact surfaces [24] of the straight portion of the slot is extended with a cross hatch plane [24'] to show that it is a contact surface is perpendicular to the length of the magazine well. The length direction of the extension of the magazine well is indicated in this figure by the double-arrow dash and long dash axis line [23.]

The hammer is pivotably attached to the frame and rotates about axis [$p_2$.] The sear [9] is pivotable coupled to the hammer. The sear has lower projections [52] that interact with the trigger for cocking and releasing of the hammer. Although exploded, these components are depicted in their "home" or "safe" condition wherein the fingers [54] of the transfer bar safety hold the hammer away from the breech flap or potential primers.

FIG. 8*c* shows an oblique, front right top view of an embodiment of a trigger [20] component for a concealable pistol in accordance with the invention. The trigger features include a downward projecting lip [50] which is convenient for pushing the trigger forward as one of the steps used to advance or remove a magazine from the magazine well of the frame. The trigger body bifurcates into two membrane sections which reach around the sides of the magazine and magazine well. Each membrane includes pierced features and inward-facing camming features. In preferred embodiments these features are symmetric across a midplane or z-x plane of the coordinate system shown in FIG. 1*a*, wherein the x-axis is the shooting axis of the gun barrel.

Each membrane includes a prong with a tip [51] which butts up against the fingers of the sear to cock the hammer. Each membrane also includes a zig-zag slot with a dwell portion [24] wherein a lug of the transfer bar safety resides while in a "safe" condition wherein a blocking bar or finger of the transfer bar safety is oriented to block the fall of the hammer. A main lifting surface lifts the magazine round lugs into firing position and is not visible in this figure, but a secondary lifting surface [47] is visible and acts to lift the magazine lug when the trigger is returning to a "home" position after firing. A secondary trigger spring lug [68] is a vertical peg that rides within a longitudinal slot in the frame and interoperates with a compressible elastic member or spring to oppose forward excursion of the trigger beyond its "home" position.

FIG. 8*d* shows an oblique, rear right bottom view of the trigger component [20] of FIG. 8*c*. In preferred embodiments the inner facing guide surfaces and features are symmetric across a midplane or z-x plane of the coordinate system shown in FIG. 1*a*, wherein the x-axis is the shooting axis pf the gun barrel. A main lifting surface [45] lifts a magazine into firing position by its lateral protrusions. There are two types of secondary lifting surfaces in this design, one type ([47] of FIG. 8*c*) acts to lift the magazine lug when the trigger is returning to a "home" position after firing, but the other type of secondary lifting surface [46] seen in this view acts to depress a magazine lug directly beneath it and push the magazine in the magazine well into a "safe" carry position. The cylinder alignment lug [53] is used as a stop element to confirm that the cylinder is aligned with the frame and barrel by entering into a corresponding notch in the magazine which is registered to a chamber to be fired.

FIG. 8*e* shows a cross section view of the trigger component [20] of FIG. 8*c*, taken at section line A-A of FIG. 3*b*. The trigger forward hook [50] is used by one finger to move the trigger forward when removing the magazine. The main lifting surface [45] lifts the magazine lateral projections into their respective firing positions and aligns the cylinder with barrel. The cylinder alignment lug [53] is used to confirm that the cylinder is aligned with the frame and barrel by entering into a corresponding notch in the magazine which is registered to a chamber axis. Secondary lifting surface [46] acts to depress a magazine lug directly beneath it and move the magazine in the magazine well into a "safe" carry position. Secondary lifting surface [47] acts to lift the magazine lug when the trigger is returning to a "home" position after firing. The transfer bar safety guide is the zig-zag channel bounded by guide surfaces [24] that control the lug on the transfer bar safety. Just before the pistol fires, the transfer bar is dropped which moves its blocking finger from the blocking condition wherein the hammer cannot drop its firing pin onto a primer, to the operation condition wherein the firing pin can reach the primer. The sear finger [51] pushes the sear backwards and cocks the hammer. To fire, the sear finger goes back far enough for the sear to slip past over the finger.

FIG. 9*a* shows a cross section view of the pistol of FIG. 1*a* taken at section line A-A of FIG. 3*b*, with its folding grip in a deployed position. The pistol comprises a frame [3] and a barrel connected to the frame which in this embodiment is integral to the frame. The frame has a grip portion [3*b*] defining an elongated magazine well, and an elongated magazine [30] is shown removably received in the well. A firing assembly includes a hammer [8] with a firing pin element [8*h*] spring biased toward the magazine by hammer spring [64.] The hammer is cocked and released by a sear [9] and its finger [75] operated by the trigger (omitted in this figure.)

The magazine [30] is shown in a fully loaded condition in which an uppermost chamber is registered with the barrel. The cartridges are shown in each chamber in phantom line, and the trigger assembly is operable when in the fully loaded condition to discharge a cartridge in the uppermost chamber when the hammer firing pin tip would enter the magazine and strike the primer of the uppermost cartridge.

The pistol is shown ready to fire with its muzzle device [25] extended, which adds space for accessories attached to hang downward in the region shown by a box in phantom line, since they may move forward and clear the space for gripping fingers when the muzzle device is extended. However, while retracted and with the folding grip [14] rotated forward, the attachments and the bottom edge of the grip will form a substantially rectangular perimeter which is less recognizable to the general populace as a weapon profile. A subsidiary aspect of effective concealment while "hiding in plain sight" is to break up or re-arrange recognizable shapes so they present as shapes outside the range of the expected or targeted shapes. When the folding grip is rotated forward for concealment, the latch [15] snaps onto a hook portion [16] of the frame by the underside of the trigger.

FIG. 9*b* shows a cross section view of the pistol of FIG. 1*a* taken at section line B-B of FIG. 3*b*, with its folding grip [14] in a retracted and compact position which is also a "safe" position. Aftward movement of the trigger [20] is blocked by safety fingers [17] extending upward form the folding grip. These fingers also retain muzzle device [25] in a retracted position. Straight and true extension of the muzzle device is effected by the plurality of struts of which [27*b*] is one seen in this cross section, and by laterally projecting studs [29*a*] which are part of the barrel and which ride within inward-facing grooves [29*b*] in the muzzle device. In this exemplary embodiment the barrel is also an integral part of the frame [3.] One of the lower struts of the muzzle device is also seen in this figure with a hook portion

[26] at its tip. The safety fingers of the folding grip catch the strut tip hooks to retain the muzzle device in a retracted position while the folding grip is stored in its retracted and latched position shown in this figure. Also, with the folding grip in this retracted position the safety fingers block rearward movement of the trigger and prevent cylinder alignment lug [53] from entering into and registering with the forward-facing magazine alignment notch [38.]

In this cross section the magazine wings [33] that prevent over-insertion and the plurality of magazine follower elements [42] are seen and cut through by the cross section plane. The sear [9] at this cutting plane is only seen at one of its circular axle portions where it seats in the hammer [8] at a pivot point defined by the hammer to resemble a partial journal bearing. The transfer bar safety [21] in its "safe" position tips its finger [54] counter-clockwise and aftward so that while residing within one of the slots [73] of the hammer it blocks the hammer from falling and from inserting its firing pin into a magazine chamber.

FIG. 9*c* shows a cross section view of the pistol of FIG. 1*a* taken at section line D-D of FIG. 3*b*, with its folding grip [14] in a retracted and compact position. A rear face of the safety prong [17] of the folding grip catches hook portion [26] of a tip of one of the lower struts of the muzzle device to retain the muzzle device in a retracted position.

FIG. 9*d* shows a cross section view of the pistol of FIG. 1*a* taken at section line D-D of FIG. 3*b*, with its folding grip in a deployed position. With the safety prong [17] of the folding grip [14] pivoted away from the muzzle device struts, the hook portion [26] of a strut tip is freed and the muzzle device [25] is pushed by spring force to its extended position as shown.

Figure 10A:
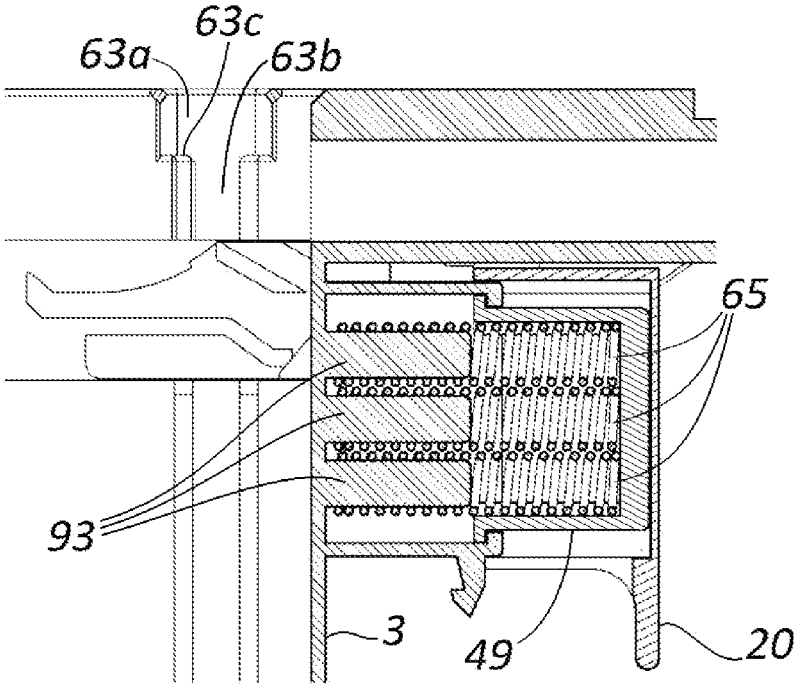
FIG. 10*a* shows a cross section view of a frame, a trigger, trigger springs, and a trigger follower component for the pistol of FIG. 1*a* taken at section line A-A of FIG. 3*b*.

FIG. 10*a* shows a cross section view of a frame, a trigger [20,] trigger springs, and a trigger main spring guide for the pistol of FIG. 1*a* taken at section line A-A of FIG. 3*b*. The magazine well includes a vertical channel open at the top and bottom of the magazine well. The channel has a width [63*b*] over most of its length and a larger width [63*a*] at its opening the near the top. In preferable embodiments the transition from the wide channel width to the narrow channel width forms a shelf [63*c*.] The plurality of lateral projections of the cylinder block (or block component of the magazine) are sized to move and slide within both widths of the channel, but the wings on the magazine that prevent over-insertion only fit within the wide portion of the magazine well channel. When inserted, the magazine will only go down until the wings encounter the shelf feature in the magazine well channel. A symmetrically equivalent channel is formed in the opposite side of the magazine well which would be visible if the view direction of section line A-A were reversed.

The main spring guide [49] limits the over-travel of the main trigger springs, so they only push the trigger back to the home position, and no further. The frame [3,] trigger main spring guide, and trigger springs [65] nest within each other. The trigger is shown in its home position, and does not feel any force from the main trigger springs. To press the trigger, the trigger guide and springs would become compressed. The trigger is free to move in the opposite direction as well because the secondary trigger springs and the frame guide this motion. The trigger arms slide in horizontal slots in the frame that communicate with the magazine well. The spring guide may preferably include guide rods [93] that prevent unwanted buckling in compression once installed in the frame. The length of the rods may be determined so that they serve as a physical stop preventing the main spring guide from traveling too far during a trigger pull.

Figure 10B:
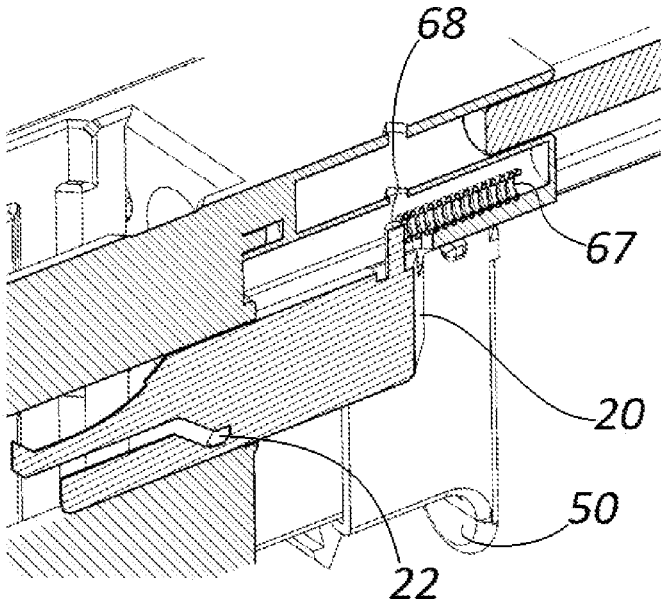
FIG. 10*b* shows an oblique, rear right top view of a partial cross section of the pistol of FIG. 1*a*, taken at section C-C of FIG. 3*b*.

FIG. 10*b* shows an oblique, rear right top view of a partial cross section of the pistol of FIG. 1*a*, taken at section C-C of FIG. 3*b*. The trigger [20] slides horizontally in the frame and is kept in place by the pins or rods ([93] of FIG. 10*a*) on which the main trigger springs push against as seen in the previous figure. A secondary trigger spring [67] shown in this figure acts on a secondary trigger spring lug [68] to bias the trigger back after being pulled forward by its downward projecting lip [50] or "trigger forward hook," such as for advancing or removing a magazine from the magazine well of the frame. Thus, at an equilibrium between the main and secondary trigger springs, the trigger is spring biased to a rest position called a "home" position.

The secondary trigger spring lug rides within a slot in the frame where it is not only biased by the secondary trigger spring, but also limited in its forward travel by the forward end of its slot. To remove a magazine, the user pushes forward on the trigger using the trigger forward hook, and after installing a new magazine and releasing the trigger the secondary trigger springs return the trigger home where its inward-facing features engage with the protruding follower elements on the magazine block.

FIGS. 11*a* through 11*g* show cross section views of a trigger motion sequence for moving or advancing a magazine of FIG. 7*a* within the pistol of FIG. 1*a*, taken at section line C-C of FIG. 3*b*. In this series of figures the magazine may only move up and down in its magazine well, and the trigger may only slide forward or backward.

Figure 11A:
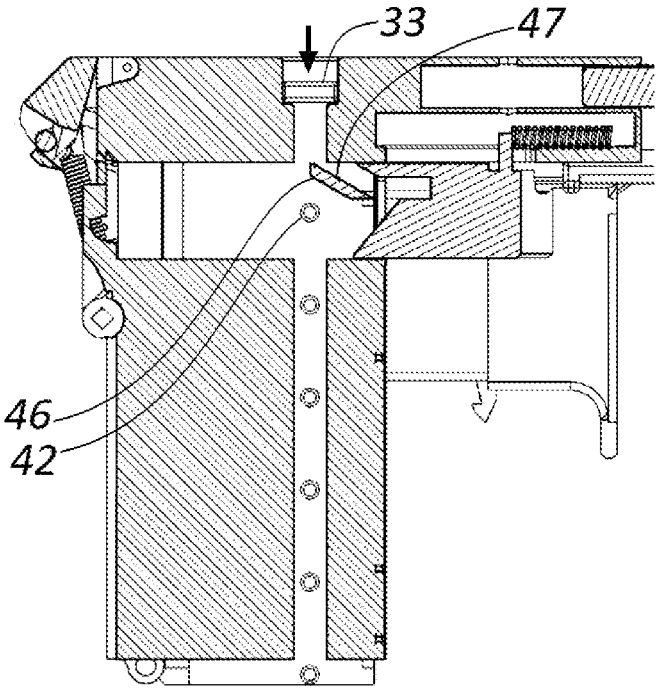
FIGS. 11*a* through 11*g* show cross section views of a trigger motion sequence for moving or advancing a magazine of FIG. 5*a* within the pistol of FIG. 1*a*, taken at section line C-C of FIG. 3*b*.

FIG. 11*a* shows how over-travel or over-insertion of the magazine is controlled by wings [33] at top of magazine. The wide portion of the magazine well groove admits the top wings of the magazine block but the magazine is halted from further insertion (arrow) in the frame's magazine well at the transition to the narrower width of the groove. The trigger is shown in its home position. The magazine has over-traveled downwards, and protrudes from bottom of the magazine well. In order to insert the magazine, the trigger is pushed slightly forward, so the trigger's lifting surfaces [46] and [47] are clear and out of the way of the magazines round lifting lug [42.]

Figure 11B:
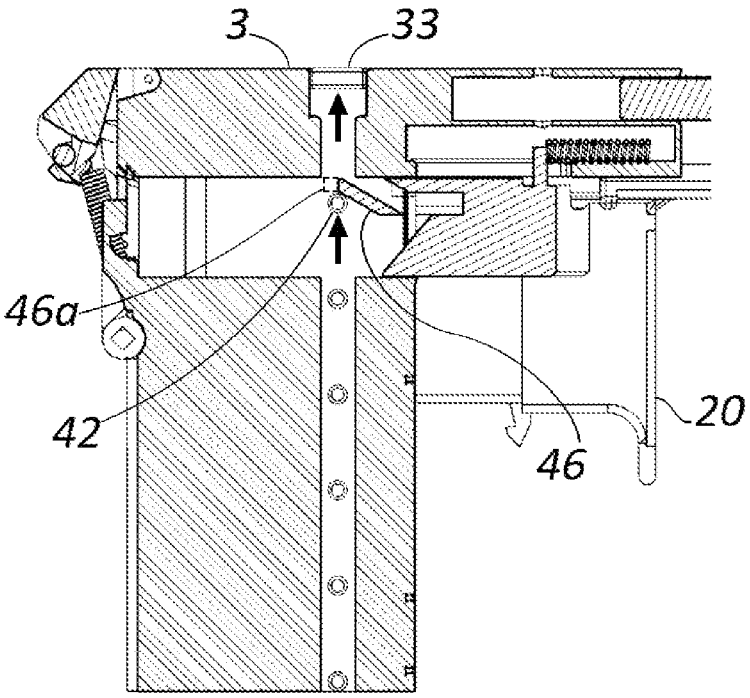

In FIG. 11*b*, the user squares up an over inserted magazine by pushing the bottom portion of the magazine upward until it no longer juts out below the bottom opening of the magazine well. In preferable embodiments the magazine length is sized so that when flush with the bottom of the magazine well, the top surface of the magazine and the insertion stop wings [33] are flush with the top of the frame [3.] A magazine may also be squared up by pressing the pistol and inserted magazine down onto a flat surface while the folding grip is latched in its retracted position. The round lugs [42] on the magazine act as follower elements as they encounter the angled surfaces of the trigger while the trigger is in motion. As the angled surfaces pass above or beneath the magazine follower elements, the magazine will translate along its length within the magazine well in response to actuation of the trigger assembly.

The trigger is still shown in its rest position and the user may begin to fire the weapon with a conventional trigger pull. The follower element or round lug abuts the underside angled surface [46] so that upward motion of the magazine is limited. In this condition the magazine cannot be removed but may slide between the safe condition of FIG. 11*a* and the ready to fire condition shown here.

According to an alternative embodiment, the sloped cam surface as shown may include an additional extension [46*a*] as shown in broken line. This extension would be provided to make it so that upwards force on the magazine cannot, or cannot easily push the trigger forward to release the magazine. This addition may be angled to provide more resistance during magazine removal, or to make it impossible as with a horizontal extension shown. The shallower the angle of the camming surfaces (i.e, the more close to horizontal,) the harder and less likely it would be for forces on the magazine applied along its axis of motion to overhaul the trigger. With the magazine first fully inserted as in FIG. 11*a* and raised slightly to be aligned with the frame as shown in this figure, and then with the grip folded, the overall profile of the weapon is minimized. The pistol may be carried in this condition which is "safe" against discharge and also the most compact volume.

Figure 11C:
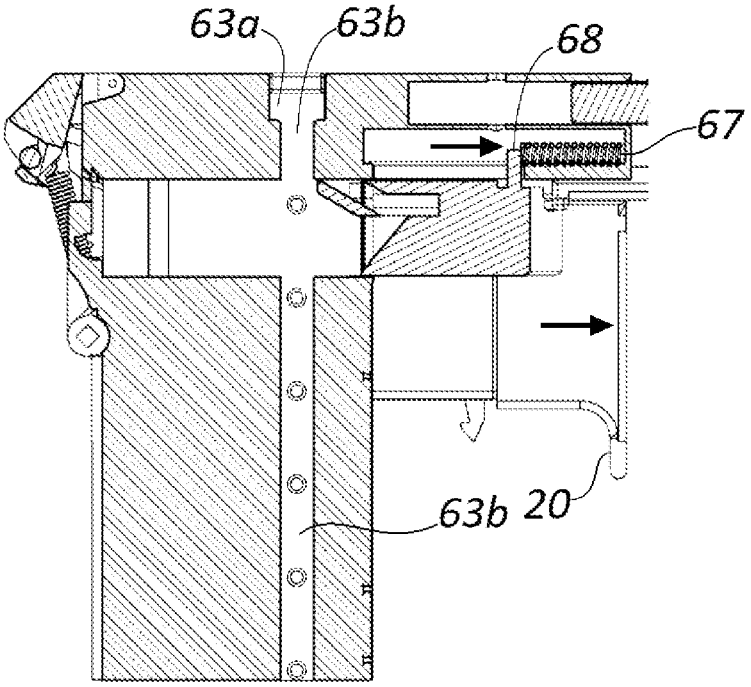

In FIG. 11*c*, the trigger [20] is shown manually pushed forward into the magazine release or loading position. This excursion of the trigger is resisted by the secondary trigger spring [67] as compressed by the secondary trigger spring lug [68] which is now biased to return the trigger to its home position. This trigger motion clears its lifting surfaces out of the way of the magazine round lugs. The stop elements of the trigger are also clear of the indexing indentations in the magazine which during firing are engaged to hold the alignment of the magazine chamber containing the cartridge to be fired in alignment with the barrel The magazine channel at the side of and opening into the magazine well has a width [63*b*] over most of its length and a larger width [63*a*] at its opening the near the top. The plurality of lateral projections of the magazine block are sized to move and slide within both widths of the channel, but the wings on the magazine that prevent over-insertion only fit within the wide portion of the magazine well channel. When inserted, the magazine will only go down until the wings encounter the shelf feature in the magazine well channel.

According to the exemplary dimensions of some embodiments in the description for FIG. 3*d*, the trigger in the position seen in this figure is pushed forward about 0.1 inch to enable the magazine to be inserted or removed, while compressing the secondary trigger springs. The middle finger may be used to push forward on the trigger, using the hook at the bottom of the trigger.

Figure 11D:
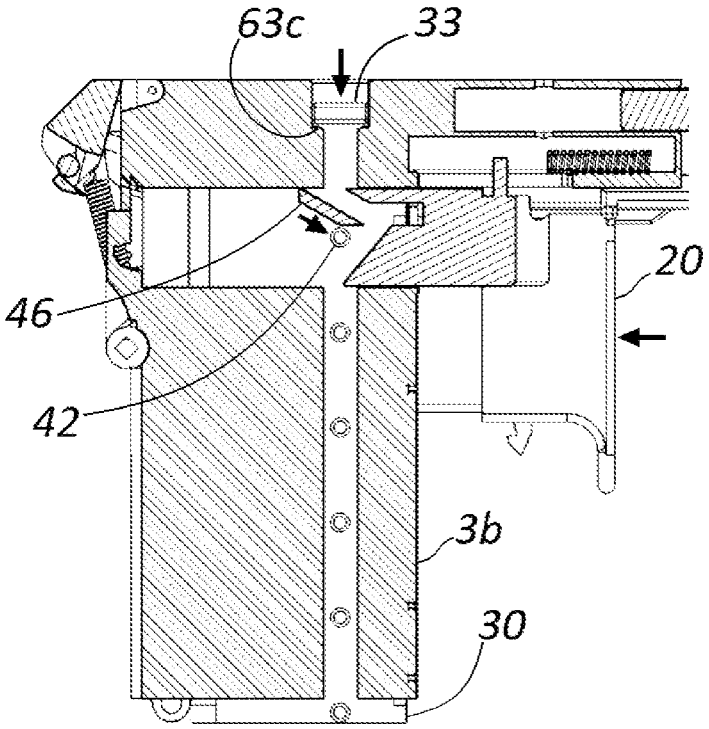

In FIG. 11*d*, the trigger is beginning to be pulled and is at a first intermediate position between its rest or "home" position and the firing moment when the sear disengages from the trigger and drops the hammer. With the magazine in an initial position with the uppermost chamber aligned with the barrel as shown, the trigger assembly includes a first magazine engagement surface [46] angled in a first orientation with respect to the magazine to drive the magazine downward in response to initial rearward movement of the trigger [20.]

After the magazine was flush with frame, which is how the pistol would be stored and ready for use, the trigger is shown in this figure as partially pulled. The first angled surface [46] of the trigger, which is on the underside of its secondary lifting surface, has pushed the magazine downwards until the magazine round lug [42] clears that angled surface. Staging for the first shot relies on the back slope of secondary lifting surface to push mag down before it returns to firing position. The magazine is drawn downward so that its over-insertion stop [33] approaches the shelf [63*c*] formed by the decrease in width of the magazine well groove. However, further pulling of the trigger from this point to the discharge point will only raise the magazine or hold it aligned with the chamber to be fired in line with the barrel. Subsequent rearward movements of the trigger operate to elevate the magazine without downward movement.

Figure 11E:
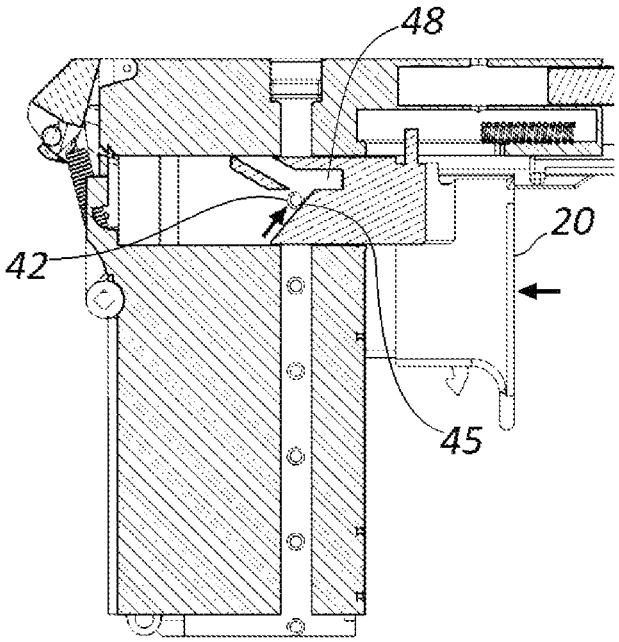

In FIG. 11*e*, the trigger [20] is shown pressed further until the main lifting surface on the trigger reaches the round magazine lug. The trigger assembly has an engagement surface [45] angularly offset from the length of the magazine well and operable to engage the follower [42] to advance the magazine wherein the engagement surface is configured to elevate the magazine in response to rearward movement of the trigger. Thus, the trigger assembly operably connected to the magazine to index the magazine along its length to sequentially align each chamber with the barrel, and to sequentially discharge each cartridge in the magazine. Pressing the trigger further would raise the magazine further so the firing chamber would be in line with the barrel as the follower element would enter and be vertically constrained within a dwell area [48] of the trigger camming features.

Figure 11F:
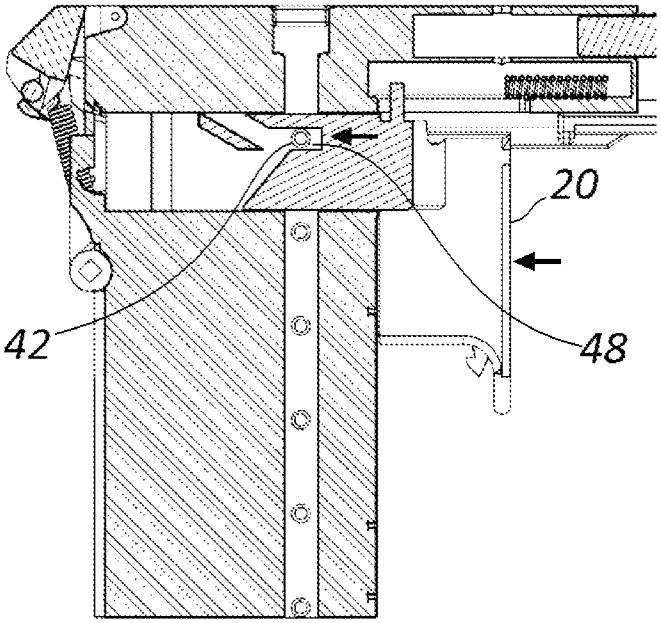

In FIG. 11*f*, the trigger [20] is pressed further and completely. The magazine follower element [42] is raised into the firing position. The channel in which the magazine round lug now resides is a dwell area [48] that guarantees that the firing chamber is properly aligned with the barrel.

Figure 11G:
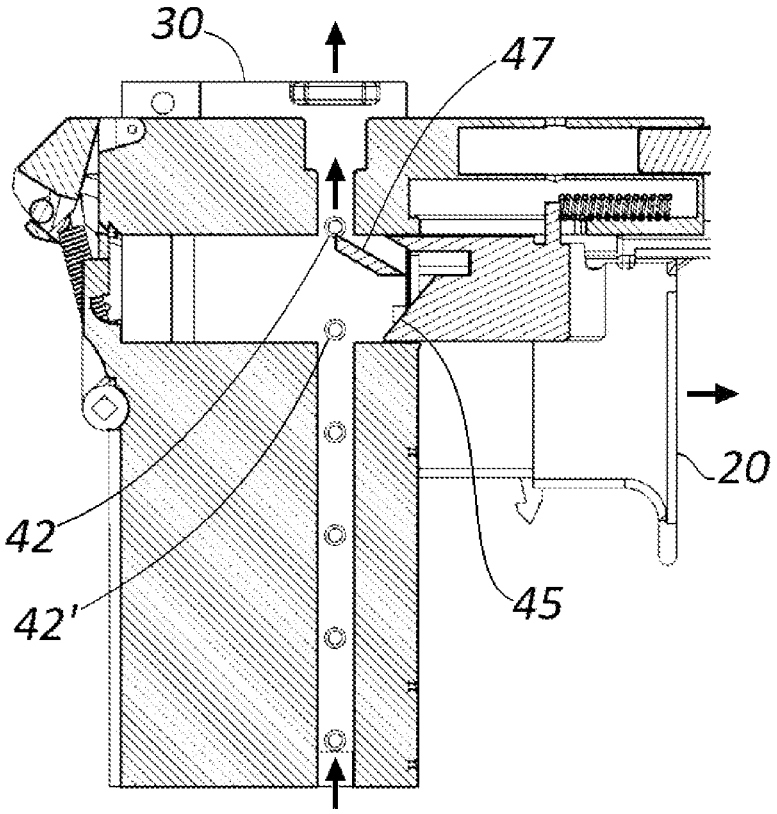

In FIG. 11*g*, the set of trigger camming surfaces include a second engagement surface [47] offset from the engagement surface [45] and configured to elevate the magazine in response to forward movement of the trigger. Thus after firing, while the trigger [20] is released and the main trigger springs push to return the trigger to the home position, the secondary lifting surface [47] on the trigger pushes the round magazine lug [42] upwards and essentially out of the action.

Since this sequence of FIGS. 11*a* through 11*f* depict the firing of the first or uppermost magazine chamber, more loaded cartridges are ready in the chambers beneath, and the next round magazine lug [42'] advances to be in front of the triggers main lifting surface [45] and the firing cycle may start again. The magazine is held in place primarily by friction, and may be shifted slightly up or down, but with another full pull of the trigger the angled camming surfaces of the trigger will guide the next lug into the firing position with the follower element vertically restrained within the dwell section ([48] of FIG. 11*f*.) With a magazine closely fitted within its well friction should be sufficient to keep the magazine from moving up and down by itself. If this does not occur, the secondary lifting surfaces would tend to trap the nearest lug in place.

Figure 12A:
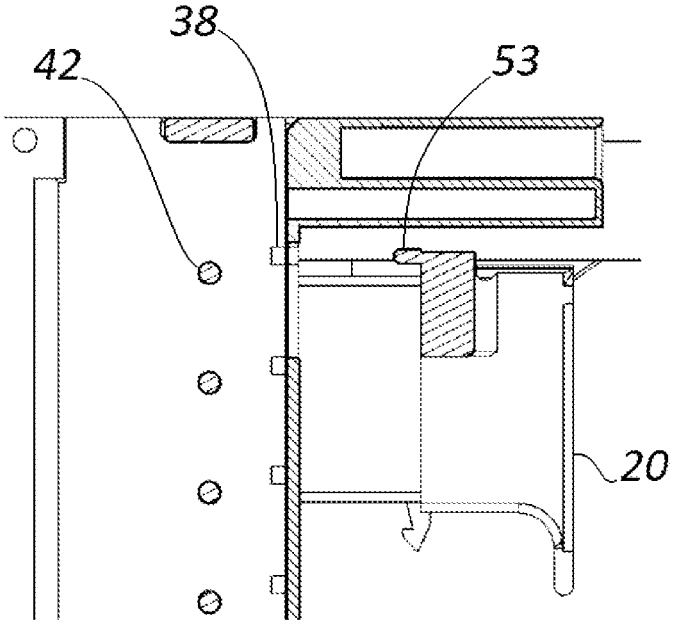
FIG. 12*a* shows a partial cross section view of features of the frame, magazine and trigger of the pistol of FIG. 1*a*, taken at section line B-B of FIG. 3*b*.

FIG. 12*a* shows a partial cross section view of features of the frame, magazine and trigger [20] of the pistol of FIG. 1*a*, taken at section line B-B of FIG. 3*b*. Here the trigger and magazine alignment pin is shown in the disengaged position. The magazine is free to move up and down. The trigger assembly includes a stop element positioned in line with the follower element [42.] The trigger and magazine alignment pin [53] is a stop element and a forward facing notch [38] on the magazine accepts the magazine alignment pin as will be seen in the next figure.

Figure 12B:
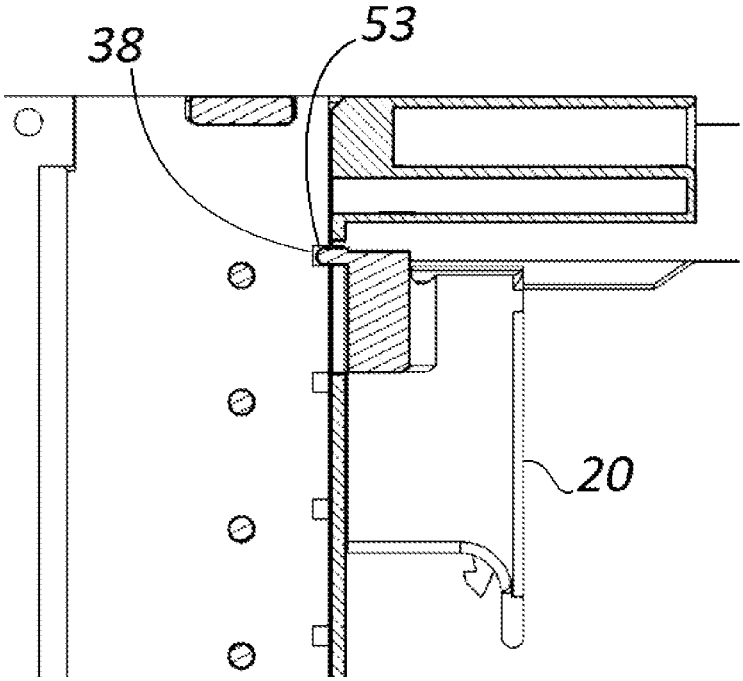
FIG. 12*b* shows a partial cross section view of features of the frame, magazine and trigger seen in FIG. 12*a* and taken at section line B-B of FIG. 3*b*, with the trigger pulled so that an alignment of a magazine chamber and the pistol barrel is enforced.

FIG. 12*b* shows a partial cross section view of features of the frame, magazine and trigger [20] seen in FIG. 12*a* and taken at section line B-B of FIG. 3*b*, with the trigger pulled so that an alignment of a magazine chamber and the pistol barrel is enforced. The stop element [53] engages one notch [38] from among the linear array of notches in the magazine assembly to lock it from vertical translation within the magazine well. Preferable embodiments of the magazine assembly as shown previously may include two or more redundant notches registered to each cartridge position along the magazine. With the trigger fully depressed, the trigger magazine alignment pin is now engaged and ensures that when the pistol fires, the magazine is properly aligned within the trigger frame and this proper alignment with the barrel is confirmed to a tighter tolerance (the stop element within the notch) than the vertical play allowed by the magazine follower pin ([42]) and dwell area ([48]) seen in FIG. 11*f*. Here in this figure the stop element slides into a slot in the magazine to confirm registration of a magazine chamber with the barrel.

Figure 13A:
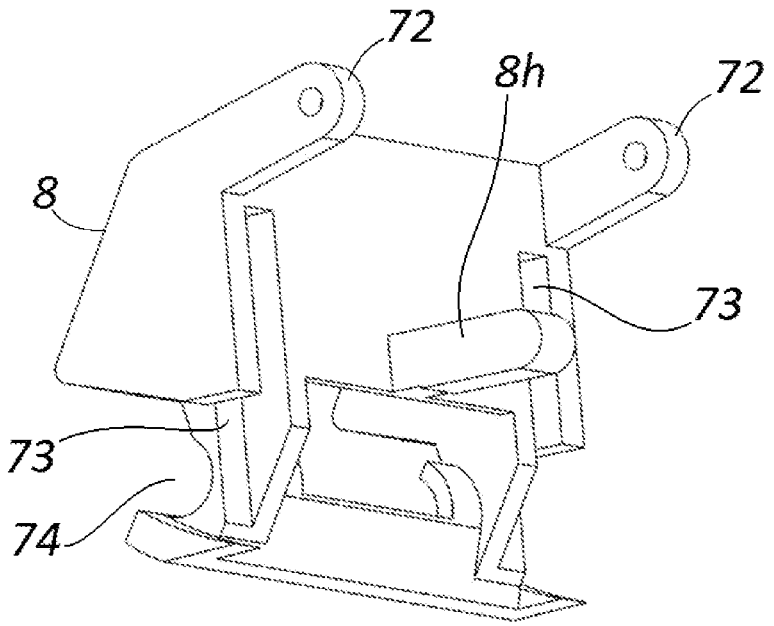
FIG. 13*a* shows an oblique, front right bottom view of a hammer component for the pistol of FIG. 1*a*.

FIG. 13*a* shows an oblique, front right bottom view of an embodiment of a hammer component for the pistol of FIG. 1*a*. The hammer [8] attaches to the frame and pivots on the two round points [72] near the top of its body. The hammer has two vertical slots [73] that interact with the transfer bar safety. These slots are where the transfer bar safety pushes on the hammer to keep the hammer's firing pin [8*h*] away from the primer and breech flap. The lower portion of the hammer body is used to hold the sear and offers two journal bearing surfaces [74] for the axle portions of the sear.

Figure 13B:
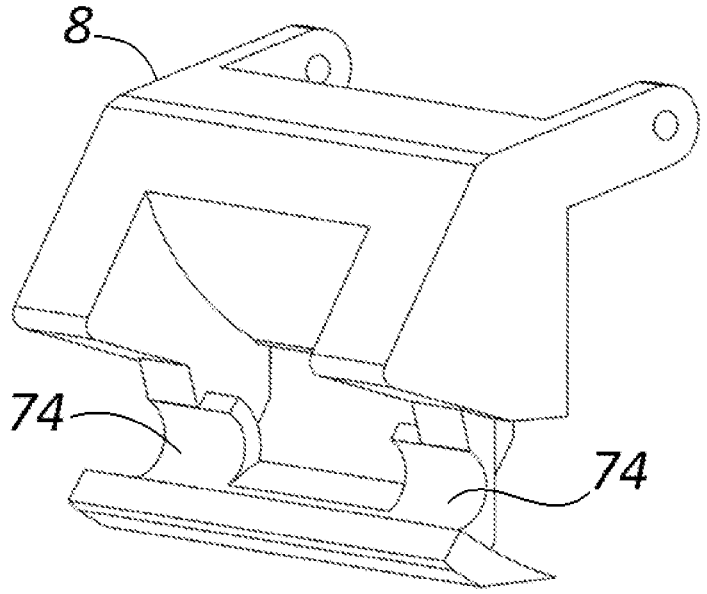
FIG. 13*b* shows an oblique, rear right top view of a hammer component for the pistol of FIG. 1*a*.

FIG. 13*b* shows an oblique, rear right top view of a hammer component [8] for the pistol of FIG. 1*a*. The cylindrical passage along the bottom rear of the hammer is where the sear rests by its axles and pivots. The lower portion of the hammer body is used to hold the sear and offers two journal bearing surfaces [74] for the axle portions of the sear.

Figure 13C:
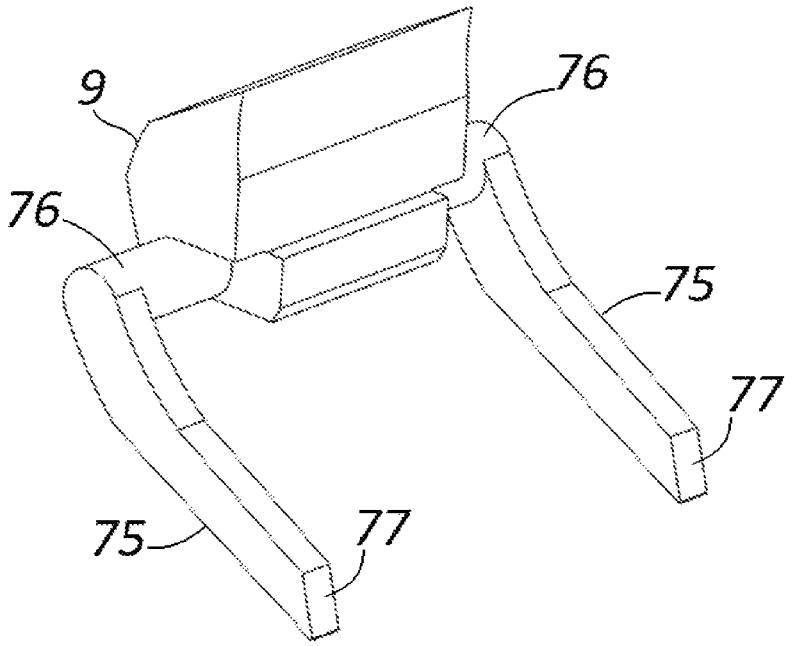
FIG. 13*c* shows an oblique, front right top view of a sear component for the pistol of FIG. 1*a*.

FIG. 13*c* shows an oblique, front right top view of a sear component [9] for the pistol of FIG. 1*a*. The sear has a cylindrical shaft or axle portions [76] that rest in the hammer, on which the sear may pivot. The sear also has long fingers [75] on which the hammer pushes in order to cock the hammer. During final stage of firing, the tips [77] of these fingers slip off of the trigger, and the sear and hammer are released to fire the gun. The trigger assembly, sear, and hammer all use component features arranged in pairs across a central plane of symmetry as these redundant elements working in tandem increase the reliability of the action.

Figure 13D:
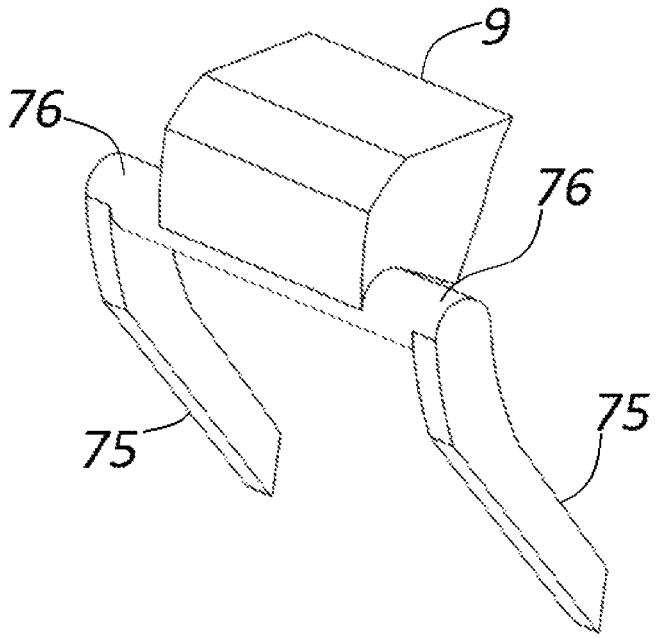
FIG. 13*d* shows an oblique, rear right top view of a sear component for the pistol of FIG. 1*a*.

FIG. 13*d* shows an oblique, rear right top view of a sear component [9] for the pistol of FIG. 1*a*. The sear has cylindrical shaft or axle portions [76] that rest on the hammer, and upon which the sear may pivot. The sear also has long fingers [75] on which the hammer pushes in order to cock the hammer.

Figure 14A:
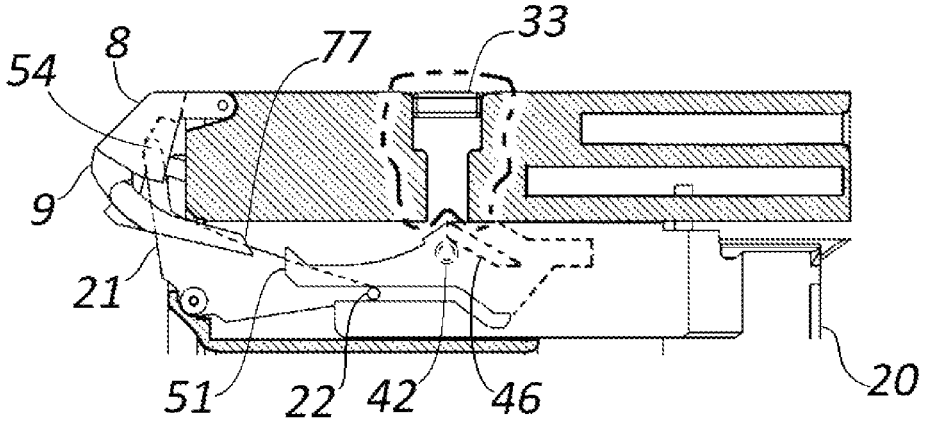
FIG. 14*a* shows a composite, partial cross section view of the trigger, frame, and magazine features and fire control components of the pistol of FIG. 1*a* with the magazine stored in a "safety" condition which is especially compact.

FIG. 14*a* shows a composite, partial cross section view of the trigger, frame, and magazine features and fire control components of the pistol of FIG. 1*a* with the magazine stored in a "safety" condition which is especially compact. FIGS. 14*a* through 14*f* illustrate stages of a trigger pull up to the sear release and discharge of the weapon. Most of this cross section view is taken at section line C-C of FIG. 3*b* but a broken portion near the center of the figure and bounded by the heavy phantom line boundary is taken at section line B-B of FIG. 3*b* so that the interoperation of the trigger assembly features and the magazine components may be seen simultaneously in the figures. Other portions of relevant components out of the cutting plane are shown in dashed lines. Many components and features shown in operation at cross sections B-B and C-C are duplicated by equivalent components and features arranged symmetrically about midplane A-A of FIG. 3*b*. These redundant mechanisms essentially double the operational reliability of the weapon.

The firing mechanism includes a sliding or translating trigger [20] pulled by two fingers which (1) indexes the cartridge chamber magazine, (2) cocks the hammer, (3) disables the transfer bar safety, (4) locks the chamber in line with the barrel, (5) releases the hammer, (6) indexes the magazine, (7) re-enables the transfer bar safety, and (8) resets the trigger. Also the trigger may be pushed forward by its hook to allow magazine removal and exchanges. The position shown in this figure is the compact carry configuration with the bottom of the magazine tucked up flush with the bottom of the grip as seen in FIG. 11*b* and the transfer bar safety [21] has its blocking bar [54] extended rearward from the back of the frame which blocks the hammer [8] from inserting its firing pin portion into contact with the cartridge. The blocking bar is a vertical finger that interacts with the hammer.

When the transfer bar safety is enabled, the vertical fingers lift the hammer and its firing pin aftward off of the primer and out of the breech flap, and hold the hammer in a "safe" position. Although the condition shown is the most compact, When the top of magazine is flush with top of frame, the weapon is not really in a safety condition for the magazine because the magazine chamber is in line with the barrel as compared to other conditions no cartridge exactly aligned with the barrel and the firing pin is not aligned with any primer.

In the carry position, the magazine over-insertion wings [33] line up flush with the top of the frame as seen in the broken portion of the cross section. The magazine follower element [42] is trapped beneath a secondary lifting surface [46] of the trigger to bar any further upward excursion of the magazine, while downward excursion is limited to where the over-insertion stop meets the constriction in width of the magazine follower groove. The pin [22] or follower element of the transfer bar safety [21] is engaged within a horizontal portion of a slot formed by contact surfaces of the trigger assembly that are perpendicular to the length of the magazine well. The tips [77] of the sear pivot arms are separated from the tips [51] of the sear finger portions of the trigger assembly.

Figure 14B:
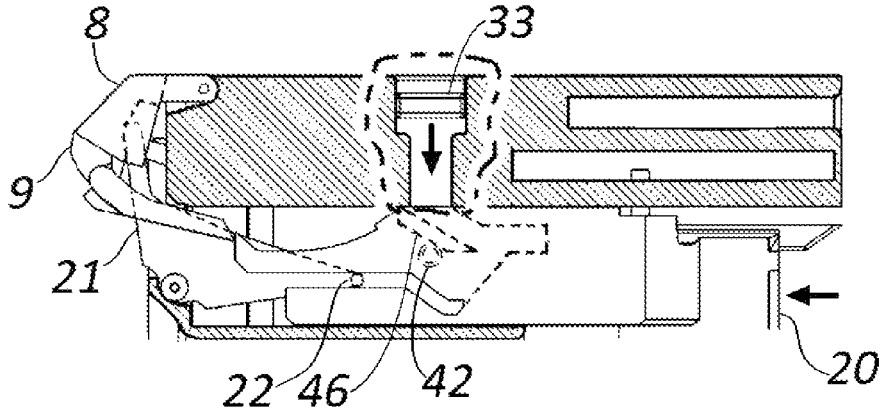
FIG. 14*b* shows a composite, partial cross section view of the trigger, frame, and magazine features and fire control components of the pistol of FIG. 14*a* with the trigger being pulled from a rest or extended position into a first intermediate position.

FIG. 14*b* shows a composite, partial cross section view of the trigger, frame, and magazine features and fire control components of the pistol of FIG. 14*a* with the trigger being pulled from a rest or extended position into a first intermediate position. Most of this cross section view is taken at section line C-C of FIG. 3*b* but a broken portion near the center of the figure and bounded by the heavy phantom line boundary is taken at section line B-B of FIG. 3*b*. Other portions of relevant components out of the cutting plane are shown in dashed lines. An engagement surface [46] of the trigger [20] has engaged with a protuberance [42] on the magazine to depress it. The tip [51] of the trigger sear fingers have approached but not yet contacted the tips [77] of the pivot arms of the sear [9.] In this condition the transfer bar safety [21] is holding the hammer [8] away from the breech flap or potential primers. By pivoting when the zig-zag portion of the trigger groove lowers the follower pin [22,] the transfer bar safety is movable between the blocking condition shown, in which the firing pin element is blocked from interaction with a cartridge, and a subsequent operational condition in which discharge is enabled. During this motion of the trigger, the uppermost chamber in the magazine moves from being aligned with the barrel centerline to a misalignment slightly below the barrel centerline. The user would see the over-insertion wings [33] of the magazine drop into the magazine well grooves. When flush, the cylinder is in line with barrel. During a firing sequence it dips down below the barrel, then goes back up to being aligned to fire.

Figure 14C:
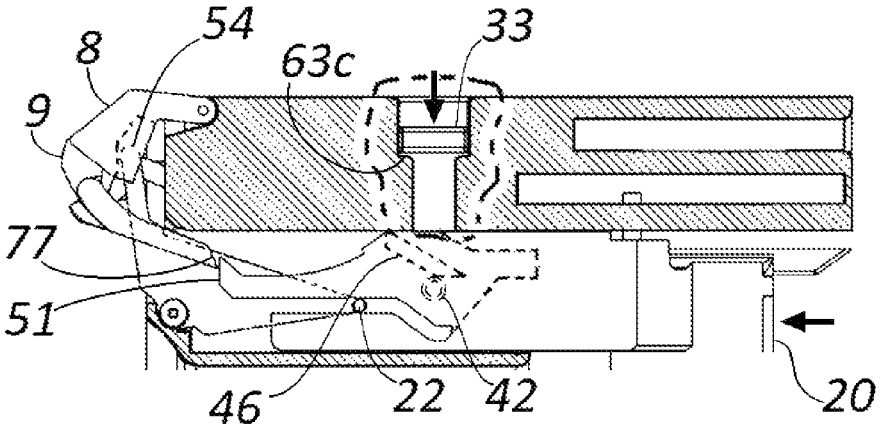
FIG. 14*c* shows a composite, partial cross section view of the trigger, frame, and magazine features and fire control components of the pistol of FIG. 14*a* with the trigger being pulled from the first intermediate position to a second intermediate position.

FIG. 14*c* shows a composite, partial cross section view of the trigger [20,] frame, and magazine features and fire control components of the pistol of FIG. 14*a* with the trigger being pulled from the first intermediate position to a second intermediate position. Most of this cross section view is taken at section line C-C of FIG. 3*b* but a broken portion near the center of the figure and bounded by the heavy phantom line boundary is taken at section line B-B of FIG. 3*b*. Other portions of relevant components out of the cutting plane are shown in dashed lines. The over-insertion wings [33] drop further within the magazine well grooves and seat upon a stop [63*c*.] The magazine follower element [42] has cleared beneath the underside surface [46] of the secondary lifting surface of the trigger assembly. The tips [51] of the trigger sear fingers have contacted the tips [77] of the pivot arms of the sear [9.] Further trigger pulling will begin to pivot the sear and cock the hammer. The transfer bar safety follower pin [22] remains within the horizontal portion of the trigger assembly camming groove, and so the transfer bar safety has not pivoted. The transfer bar safety finger [54] continues to block the hammer [8] from falling and pries the hammer firing pin out from the breech flap rear groove.

FIG. 14*d* shows a partial cross section view of the trigger, frame, and fire control components of the pistol of FIG. 14*a* taken at section line C-C of FIG. 3*b*, with the trigger being pulled from the second intermediate position to a third intermediate position with the sear approaching but not yet able to release the hammer to fall. Other portions of relevant components out of the cutting plane are shown in dashed lines. Continuing with the trigger pull, the trigger [20] pushes the sear backwards by its sear finger tips [51] pressing on the pivot arm tips [77] of the sear, which causes the sear [9] and hammer [8] to pivot as one rigid body. The main lifting surface [45] raises the magazine to align a chamber registered with the magazine follower pin [42] into alignment with the barrel of the weapon.

Looking at the transfer bar safety lug [22] and the trigger channel, if the trigger is pushed any further, the transfer bar safety will pivot and start to be disabled. The transfer bar safety is still in the "safe" position at this point but the hammer and sear have been rotated so the hammer no longer rests on the transfer bar safety, and instead is being held by the trigger assembly. The transfer bar safety finger still blocks the hammer from dropping its firing pin into a magazine chamber. If the trigger were to be released from here, the main trigger springs would move the trigger rightward in this figure back to the home position of FIG. 14*a* but with the magazine still depressed as in FIG. 14*c*. The transfer bar safety is pivotally connected to the frame at an intermediate position which is the pivot point in between its safety finger and the transfer bar safety lug. The transfer bar safety operably engages the trigger assembly at a forward portion forward of the intermediate position by means of its control groove interacting with the transfer bar safety lug. The transfer bar safety in this position operably engages the firing mechanism as a blocking portion [54] above the intermediate position or pivot point.

FIG. 14*e* shows a partial cross section view of the trigger [20,] frame, and fire control components of the pistol of FIG. 14*a* taken at section line C-C of FIG. 3*b*, with the trigger being pulled from the third intermediate position to a fourth intermediate position with the sear at its release point for the hammer [8] to fall. Other portions of relevant components out of the cutting plane are shown in dashed lines. Continuing the trigger pull, the magazine chamber is now brought into alignment with the barrel for firing. The trigger component assembly includes a second magazine engagement surface ([45] of FIG. 14*d*) angled in a second orientation with respect to the magazine to further elevate the magazine in an upward direction in response to subsequent rearward movement of the trigger to a position in which the uppermost chamber is registered with the barrel. The registration of the chamber with the barrel is initially confirmed by the magazine follower element [42] entering into the dwell area [48] of the trigger camming features and redundantly confirmed by the interaction of the cylinder alignment lug as a stop element locking in with a complementary notch in the magazine block as seen in FIGS. 12*a* and 12*b*.

As the trigger continues moving rearward, the trigger control groove drops the transfer bar pin [22] following within it to pivot the transfer bar to so that its blocking bar [54] tucks closely against the rear surface of the frame and no longer interferes with the fall of the hammer. This position of the transfer safety bar is an operational condition in which discharge is enabled. The trigger assembly is operable to cock the firing assembly upon actuation of the trigger to a first threshold shown in this figure, and the sear pivots in the direction where the sear finger may lift upwards (as shown with its pivot arms in phantom lines) so that if the trigger is pushed past this threshold or "break point" the trigger sear finger tips [51] will slip under the sear pivot arm tips [77,] the hammer will fall, and the sear will reset when the trigger returns home, with its sear fingers passing beneath the sear pivot arms after firing.

Just before firing (in this last stage of the trigger pull but excluding any "follow through" pulling past this point shown,) the transfer bar safety is disabled and brought close to the rear surface of the frame and the hammer will be free to strike the primer when the sear is released. The hammer is shown in this figure cocked and ready to be fired. The engagement between the trigger and sear is very small, and any further pull of the trigger will cause the sear to slip past the trigger assembly and the hammer and sear will swing to hit to primer.

The pivoting action of the zig-zag jog of the trigger control groove pivots the transfer bar safety by its lug to move its safety finger from the blocking condition to the operation condition only in response to actuation of the trigger assembly to a selected threshold prior to the first threshold.

FIG. 14*f* shows a partial cross section view of the trigger [20,] frame, and fire control components of the pistol of FIG. 14*a* taken at section line C-C of FIG. 3*b*, with the trigger being pulled from the fourth intermediate position to a fully retracted position past the first threshold and with the sear having previously released the hammer to fall. Other portions of the relevant components out of the cutting plane are shown in dashed lines. In this figure the trigger has been pushed completely and now no longer holds the sear. The sear and firing assembly has been released and the pivot arm tips [77] of the sear swing past the sear finger tips [51] of the trigger assembly. The hammer [8] strikes the primer and the transfer bar safety finger [54] will not interfere with its complete fall and the firing pin entering a chamber to strike a primer.

According to the exemplary dimensions of some embodiments in the description for FIG. 3*d*, the trigger in the position seen in this figure is pulled by about half an inch from its original home position by one or more of the shooters fingers to fire the gun while pushing against the primary trigger springs.

FIG. 15*a* shows a partial cross section view of the trigger [20,] frame, and fire control components as seen in of FIG. 14*a* but taken at section line B-B of FIG. 3*b*, and with the trigger being partially released after shooting a cartridge in the uppermost chamber of the magazine. Other portions of relevant components out of the cutting plane are shown in dashed lines. The sequence of FIGS. 15*a* through 15*c* show a magazine advance during release of trigger after firing and as the trigger moves toward its home position. The transfer bar safety [21] pivots up at transfer bar safety lug [22] and the safety finger or blocking element [54] is now re-engaged.

The length of the moment arm from the transfer bar safety lug to the pivot point is longer than the moment arm length from the pivot point to the contact point of the hammer slot end wall and the safety finger, providing mechanical advantage to push the hammer rearward and out of the window of the breech flap pertaining to the chamber and cartridge which was just fired. The trigger is in just about same position as seen in FIGS. 11*e* and 14*d* except that now the sear is over the trigger, and isn't being held cocked by the trigger. The secondary magazine lifting surface [47] raises the magazine by its follower element [42] so that its top is once again flush with the top of the frame. The magazine remains vertically held in place by the secondary lifting surface on the trigger. In an unexpected condition where the trigger won't continue forward to home on its own (such as by failure of the main trigger springs or a jam in the main trigger spring and its internal guide ([49] of FIG. 10*a*) then upwards force may be applied to the magazine and the trigger will be forced forward and the magazine will advance upwards. This method of magazine extraction would only be performed in unusual failure conditions. The lifting surfaces also trap the magazine in the gun, and also allow the gun to be stored with the magazine flush with the barrel, without the trigger being pulled or the magazine being stored below the barrel. This condition as a storage condition immediately after firing, while not impossible, would be unlikely as most firearms users disassemble and clean the firearm components after firing and so a storage condition as seen in FIG. 11*b* would be much more likely and convenient both for long-term storage and for immediate use.

FIG. 15*b* shows the partial cross section view of the trigger, frame, and fire control components of FIG. 15*a*, taken at section line B-B of FIG. 3*b*, but with the trigger further released and at or near its resting, extended position. Other portions of relevant components out of the cutting plane are shown in dashed lines. In this figure the trigger has lifted the magazine [30] enough so that pulling the trigger would restart the firing sequence with the next chamber below. At this configuration point the trigger is reset, although it is also possible to reset the trigger and sear immediately after the hammer falls in FIG. 15*a*, it is also possible for the trigger to reset at the same time or slightly thereafter.

FIG. 15*c* shows the partial cross section view of the trigger [20,] frame, and fire control components of FIG. 15*a*, taken at section line B-B of FIG. 3*b*, with the trigger partially pulled to begin a second shot. Other portions of relevant components out of the cutting plane are shown in dashed lines. The relative positions of the trigger lifting surfaces and the magazine follower elements are roughly the same as are seen in FIG. 14*d*. The main lifting surface [45] engages the magazine by its follower element [42] and the leftward excursion of the ramp raises the magazine [30] to align the next chamber with the barrel. The reader may now revisit the paragraph pertaining to FIG. 14*d* and repeat a study of the firing cycle.

FIG. 16*a* shows an oblique, rear right top view or a partial cross section of the trigger and fire control components taken at cross section line D-D of FIG. 3*b*. The hammer spring attaches to the sear [9] forward of its pivoting axis in order to pull the sear and hammer [8] downwards, and also to apply a torque on the sear which resists the upward lifting of the sear fingers and helps present their tip faces to the sear finger tip faces of the trigger [20.] The hammer also limits the pivoting of the sear so the spring keeps the sear in its home position until the trigger is pulled, which would then engage the sear and begin to cock the hammer.

The trigger element includes a transfer bar safety control groove that defines a contact surface operably engaging the transfer bar. One such contact surface [24] is extended with a cross hatch plane [24'] to show that it is a contact surface is perpendicular to the length (i.e, a longitudinal extension) of magazine the well [4] and shown as a heavy dash and long dash line [23] substantially parallel to the magazine follower grooves [63] which face into the magazine well. The trigger element contact surface engages with the transfer bar safety at a transfer bar safety lug [22.] According to alternate embodiments within the scope of the invention, the hammer pivot position [72] may be moved to almost any other location behind the magazine, and in some embodiments this would move the trigger away from the edges of the gun and free more space near the edge of the pistol to enable more room for sights.

FIG. 16*b* shows an oblique, rear right bottom view of the fire control components of FIG. 16*a* taken at cross section line D-D of FIG. 3*b*. As seen in FIG. 16*a*, the hammer spring [64] attaches to the sear forward of its pivoting axis in order to pull the sear [9] and hammer [8] downwards, and also to apply a torque on the sear which resists upward lifting of the sear fingers and helps present the tip face [77] of the sear arms to the trigger finger end face [51] of the trigger assembly [20.]

In a summary of the operations of the transfer bar safety as seen in FIGS. 14*a* through 14*f*, 15*a* through 15*c*, and 16*a* and 16*b*, it is observed that on the pull of the trigger, to fire the gun, the transfer bar safety preferably remains in a blocking condition until the sear or hammer or both collectively are supported by the trigger. When the trigger is holding the hammer or sear (or both) the transfer bar does not also need to hold it although in some embodiments of the invention it may be configured to do so and thus provide a redundant safety condition. In this safety condition, the firing pin is prevented from falling into the path of the breech flap. If the trigger is released after an incomplete pull, the transfer bar returns to a blocking condition and the either the hammer or sear or both become prevented from interfering with the breech flap and prevented from reaching the primer earlier in the firing cycle than when the sear is imminently ready to trip free from the sear finger of the trigger.

Although unlike openly carried firearms, concealed firearms are much less susceptible to extraneous and unintentional trigger pulls caused by encounters with foreign objects such as walking past a projecting twig or a strand of farm fence wire, but nevertheless in any carrying environment it is not impossible for straining fabric, a fall while walking, or other unexpected events to partially displace a trigger of a concealed firearm. Thus, prudent design includes preferable embodiments within the scope of the invention wherein the transfer bar safety remains in a blocking condition for a substantial portion of the initial displacement of the trigger so that small unintentional movements of the trigger close to its "home" do not disable the safety. Preferable embodiments also enforce that the transfer bar safety remains in a blocking state while retracting the firing pin out of the magazine chamber and breech flap and also during any movement phases the magazine so the firing pin does not hit the magazine. In a preferable blocking condition, the hammer is supported by the transfer bar or by the trigger whenever the magazine is moving. Also, to prevent unwanted collisions of components, preferable embodiments stage the extraction of the firing pin from the magazine window before the magazine begins its indexing motion to the next round.

Figure 17A:
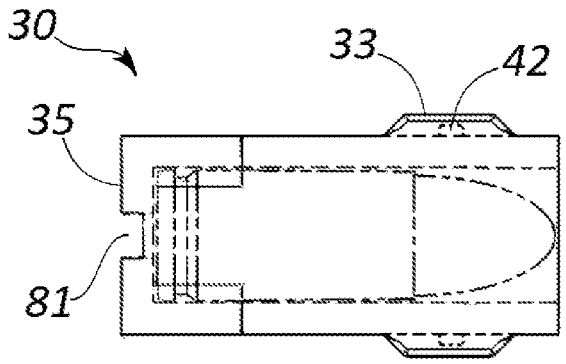
FIG. 17*a* shows a top view of an embodiment of a magazine assembly configured for use with the pistol of FIG. 1*a*.

FIG. 17*a* shows a top view of an embodiment of a magazine assembly [30] configured for use with the pistol of FIG. 1*a*. The breech flap [35] includes a rearward opening groove or "trench" [81] which allows the magazine to translate vertically within the magazine well even while the hammer firing pin tip intrudes into the well, because the groove is deeper and wider than the extent of intrusion of the firing pin tip into the well. The purpose of this groove is to allow the flap to retain thickness and strength while reducing the effective depth that the firing pin needs to enter the magazine. This make the job of the transfer bar safety easier when extracting the firing pin from the magazine. The over-insertion stop wings [33] reside flush with the top surface of the magazine and occlude direct view of the magazine follower elements or lifting lugs [42] which are thus shown in broken lines. An approximate outline of a 9 mm×19 Luger cartridge is also provided in phantom line as a size and scale reference for preferred embodiments in accordance with the invention.

Figure 17B:
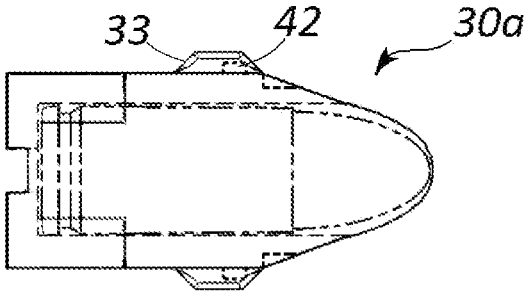
FIG. 17*b* shows a top view of an alternative embodiment of a magazine assembly configured for use with an alternative embodiment of a concealable pistol in accordance with the invention.

FIG. 17*b* shows a top view of an alternative embodiment of a magazine assembly [30*a*] configured for use with an alternative embodiment of a concealable pistol in accordance with the invention, and configured to fire larger caliber rounds while still allowing people with smaller hands to comfortably grip the pistol. Rather than an overall rectangular cross section, the magazine block is rounded and narrower at the front. An approximate outline of a 9 mm×19 Luger cartridge is also provided in phantom line as a size and scale reference for preferred embodiments in accordance with the invention, and the magazine block in this alternative embodiment is rounded to an ellipse or an ogive that closely conforms to the bullet projecting from the ammunition cartridge, with the removed material being transferred to the barrel and frame of the pistol. The over-insertion stop wings [33] and the magazine lifting lugs [42] are located further back on the magazine. While in other embodiments shown elsewhere in the specification the magazine lifting lugs are positioned centered beneath the centerline of symmetry of the wings, this is not a necessary constraint and in this embodiment the centerline of the vertically aligned set of lifting lugs is offset from the centerline of the over-travel wings.

Figure 17C:
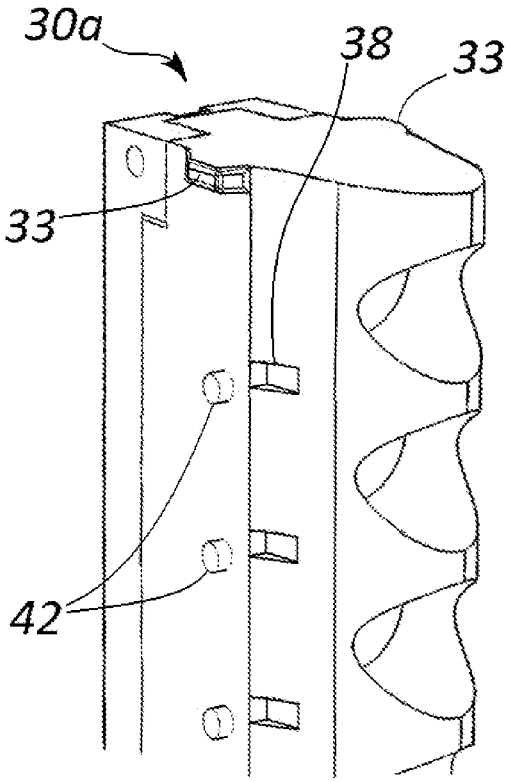
FIG. 17*c* shows an oblique, front right top view of the magazine assembly of FIG. 17*b*.

FIG. 17*c* shows an oblique, front right top view of the magazine assembly of FIG. 17*b*. The magazine assembly [30*a*] comprises a back-door breech flap similar to those described previously, over-insertion stop wings [33] flush with the top surface of the magazine, a vertically spaced apart array of lateral projections which serve as magazine lifting lugs [42,] and a related set of forward-facing notches [38] which receive and accept the magazine alignment check pins as explained in FIGS. 12*a* and 12*b*.

Figure 18A:
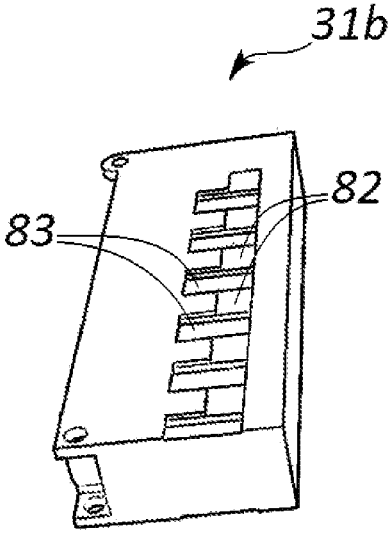
FIG. 18*a* shows an oblique, rear left bottom view of another alternative embodiment of a magazine block configured for use with another alternative embodiment of a concealable pistol in accordance with the invention.

FIG. 18*a* shows an oblique, rear left bottom view of another alternative embodiment of a magazine block [31*b*] configured for use with another alternative embodiment of a concealable pistol in accordance with the invention. Rather than having any projections outward from the magazine block surfaces, this embodiment uses a first set of rectangular pockets [82] indented into the side surfaces of the block for vertical indexing and a second set of rectangular pockets [83] for final alignment checks of each chamber to the barrel incipient to firing. The complementary trigger assembly components include pairs of cantilevered, pinchingly opposed spring beams.

Figure 18B:
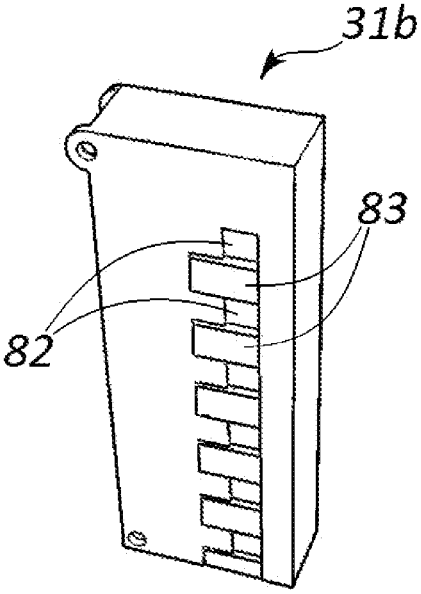
FIG. 18*b* shows an oblique, front right top view of the magazine block of FIG. 18*a*.

FIG. 18*b* shows an oblique, front right top view of the magazine assembly of FIG. 18*b* to illustrate that the second set of indentations [83] is deeper that the first set [82.]

Figure 19A:
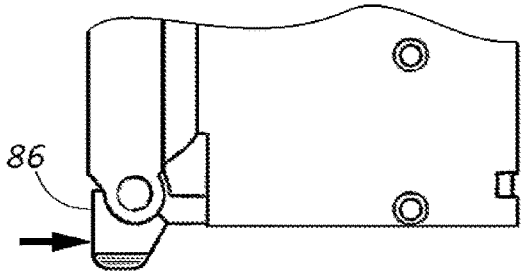
FIG. 19*a* shows a right side view of a bottom portion of an alternative embodiment of a magazine assembly that includes an anti-tilt feature.
Figure 21:
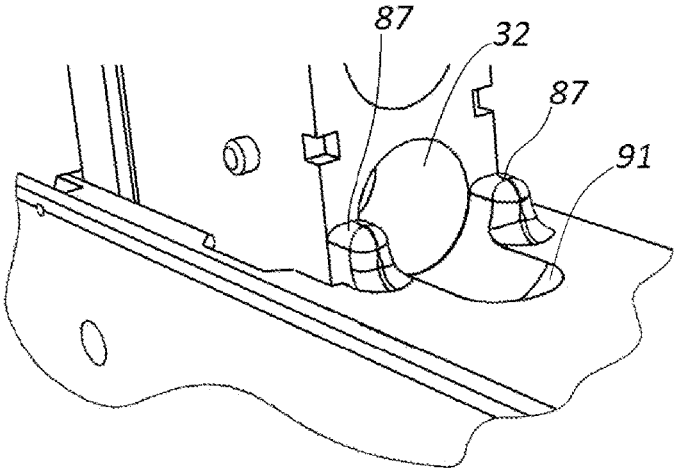
FIG. 21 shows an oblique, front right top view of a portion of an alternative embodiment of a frame for a concealable pistol in accordance with the invention in which the upper magazine well exit includes anti-tilt features and a channel for safely redirecting a bullet in the event of a hangfire.

FIG. 19*a* shows a right side view of a bottom portion of an alternative embodiment of a magazine assembly that includes an anti-tilt feature [86.] With the weapon shooting to the right in this view orientation, during recoil and especially when a substantial portion of the mass of the magazine has been advanced out of the top of the magazine well (i.e, when firing the last rounds out the bottom chambers of the magazine) recoil will impart a clockwise torque on the magazine as viewed from the right. The foot extension [86] absorbs the counter-clockwise counter-torque provided by the magazine well and indicated by the arrow at the lower left corner of this figure. Features which bolster against the complementary force couple at the top front edge of the magazine are shown in FIG. 21.

Figure 19B:
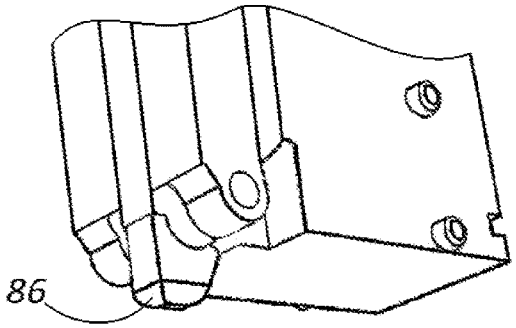
FIG. 19*b* shows an oblique, rear right bottom view of the portion of the magazine assembly seen in FIG. 19*a*.

FIG. 19*b* shows an oblique, rear right bottom view of the portion of the magazine assembly seen in FIG. 19*a*. The lower projection extent of the anti-tilt foot extension [86] may also act to aid in loading a magazine into the magazine well during low-light or sightless conditions by acting as a "feeler" or lead-in whereby a user may locate the rear rim of an open magazine well by feel.

Figure 20:
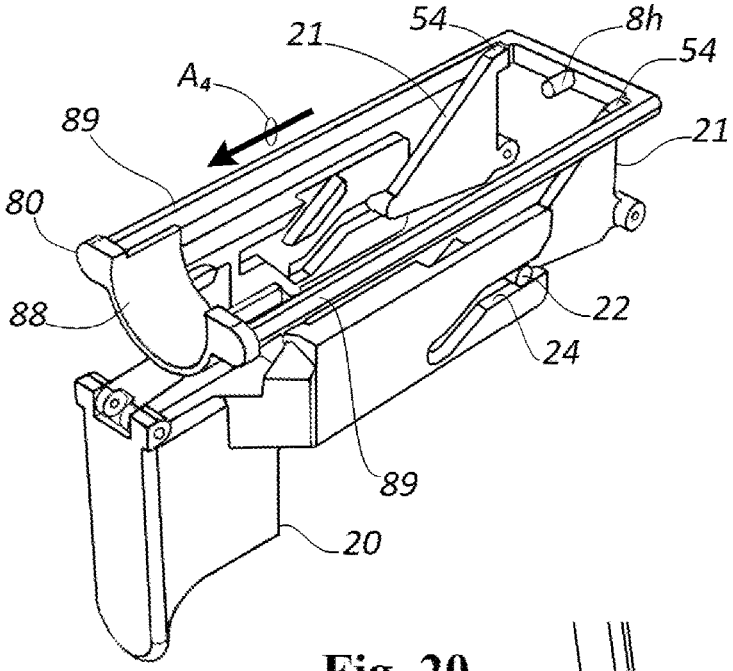
FIG. 20 shows an oblique, front top left view of an alternative embodiment of a trigger and some fire control components in accordance with the invention.

FIG. 20 shows an oblique, front top left view of an alternative embodiment of a trigger and some fire control components in accordance with the invention, using a striker setup instead of a hammer setup. The trigger [20] includes similar transfer bar safety control grooves with surfaces [24] which apprise the pivotable transfer bar safety [21] by a lug [22.] The alternative embodiment includes combination of the hammer, sear, and firing pin in a single frame-like striker component [80.] The rear bar of the frame includes the firing pin tip [8*h*] and the aft corners of the frame are reinforced to act as sear let-off surfaces simultaneously as they act as blockable surfaces restrained by the blocking fingers [54] of the pivotable transfer bar safety. The longitudinally extending bars [89] of the frame may pass through the open centers of a pair of longitudinally oriented trigger springs (not shown) which bear against the rear face of the front connecting saddle portion [88] of the frame. The saddle portion connects the forward ends of the two longitudinally frame bars while passing beneath the barrel. The trigger springs are cocked by the sear transferring the rearward motion of the trigger to the frame to move it rearward as well, and when the striker is released by the sear it accelerates forward along the direction of arrow [$A_4$.]

In another alternative embodiment of this type of assembly, rather than a pivoting hammer and sear seen as [8] and [9] seen in FIGS. 7*e*, 14*a*, and some other figures previously detailed, a linear translating striker assembly includes a translating striker with a sear, and wherein the striker may not necessarily extend to the barrel. The trigger's sear engagement surface (analogous to [51] if FIG. 14*a*) engages a sear surface on the striker, cocking the striker when the trigger is pulled, and where a cam surface or track on the frame forces the sear to disengage the trigger's sear engagement surface when the trigger is sufficiently pulled in order for the striker to be released and fire the gun. The blocking fingers of the transfer bar safety remain in a blocking position until close to the release point of the sear and striker, and the transfer bar safety is cammed, such as by a by a rise in the groove (not shown) or a by lifting surface on the trigger to dip beneath the rear of the frame and clear the frame for its forward surge when the sear releases. The sear is reset when the trigger travels to its home or rest position. In these types of firing mechanism configurations, the sear may be coupled to the combined hammer and striker component or it may be coupled to the trigger.

FIG. 21 shows an oblique, front right top view of a portion of an alternative embodiment of a frame for a concealable pistol in accordance with the invention in which the upper magazine well exit includes anti-tilt features and a channel for safely redirecting a bullet in the event of a hangfire. After several rounds have been shot, a significant portion of the magazine and its center of gravity will reside above and outside of the frame. The anti-tilt protrusions [87] buttress the frame from the reaction force applied to the upper front rim of the magazine well during recoil. A short shallow groove [91] with an upward or lateral turn at its end is aligned with a suspect un-detonated round by completing the trigger cycle and advancing the magazine so the bullet exit [34] containing the suspect round rises out of alignment with the barrel and in line with this "scoop" groove.

Unlike at a practice range or sporting event where during a hangfire the gun may be lain down on a bench with the barrel pointing downrange, in combat the user must remain engaged to neutralize the threat and will cycle the trigger again to load and discharge the next functioning cartridge. If the hangfire cartridge discharges while oriented to the deflection groove, it will be deflected safely away from the user's support hand and fingers. The robust design of the lateral rails of the breech flap add strength to contain the late-burning cartridge during a hangfire.

Figure 22A:
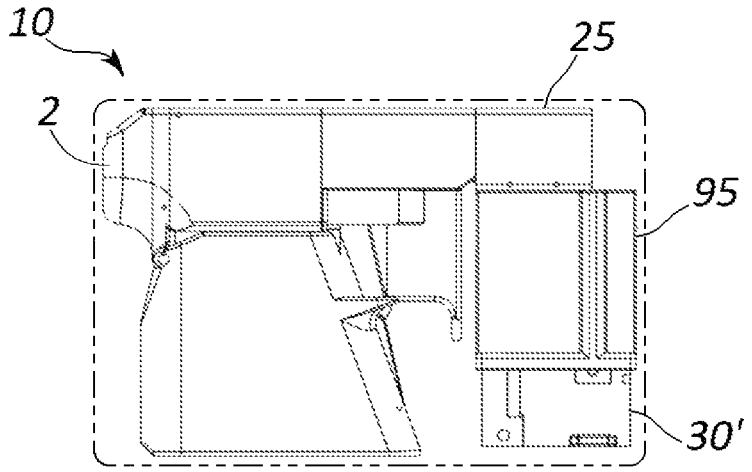
FIG. 22*a* shows a right side view of the pistol of FIG. 1*a* with the folding grip in the fire position, the muzzle device in an extended position, and with a spare magazine holder accessory attached to the muzzle device.

FIG. 22*a* shows a right side view of the pistol [10] of FIG. 1*a* with the folding grip in the fire position, the muzzle device in an extended position, and with a spare magazine holder accessory [95] attached to the muzzle device [25.] An additional magazine [30'] is shown stored in the accessory. The pistol is fitted with a cover [2] that shrouds and protects the exposed portions of the hammer and sear, leaving them less likely to catch on the internal surfaces of a fabric apparel pocket or holster, or to catch loose foreign objects in a purse. A phantom line border drawn around the package evinces the storage density of the collapsed components and also shows how the pistol with its retracted folding grip and an attached accessory closely approximate a rectangular package so that when concealed it would present a mostly rectangular bulge similar to a number of innocuous object like a wallet, a booklet, a tin of breath mints or tobacco, or any of various pocketsized electronic devices such as a flip phone or an insulin pump. There is enough room on the gun, below the trigger and between the folding grip and the muzzle device attachment, for the user to comfortably grab the grip using the ring and pinkie finger. This is how the pistol is "drawn."

Figure 22B:
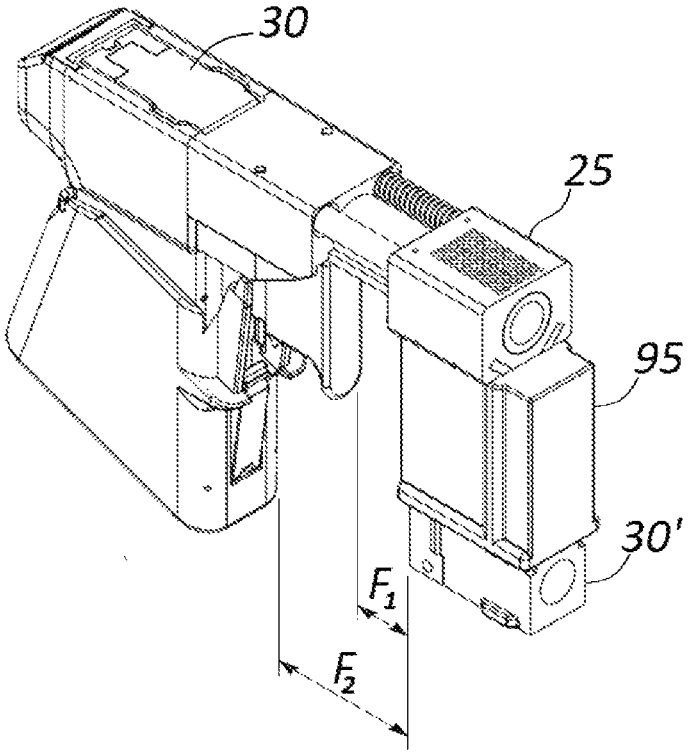
FIG. 22*b* shows an oblique, front top right view of the pistol and accessory of FIG. 22*a* with the folding grip in the fire position, and muzzle device in an extended position.

FIG. 22*b* shows an oblique, front top right view of the pistol and accessory of FIG. 22*a* with the folding grip in the fire position, and the muzzle device [25] in an extended position, which also extends the accessory magazine holder [95.] The pistol has a first magazine [30] inserted in its magazine well and a second magazine [30'] stored in the accessory magazine holder. The accessory magazine may have more or fewer chambers than the standard magazine typically furnished with the pistol. Although 4 to 8 rounds of capacity are likely to be more commonly used and carried for concealment, for other recreational shooting or for carrying separately from the concealable and substantially rectangular form of the pistol, longer magazines are practical within the scope of the invention similar to the 12, 25, and 32 round magazines produced for machine pistols.

The spare magazine carrier accessory and other accessories may use a picatinny rail system to attach to the muzzle device or some other standardized or modular mounting system such as the M-Lok slot system. The dependent accessory acts as a trigger guard in both collapsed and extended locations of the muzzle device. It is possible to make the muzzle device lock itself in its extended form so that a force pushing on the muzzle device or accessories would not also push on the shooters finger and impinge upon the trigger. In this mode the accessories act like a true trigger guard. Accessories may also serve as a hand guard that prevents the hand from ending up in front of the muzzle. A clearance dimension [$F_1$] between the front of the trigger and the rear of the accessory attached to the extended muzzle device is sufficient for one or two fingers to access and operate the trigger, and a more generous clearance [$F_2$] spans between the front surface of the folding grip as extended and the rear of the accessory.

Many modifications and variations may be made to the invention as disclosed herein without departing from its spirit and scope. For example, by replacing the coil springs [67] in FIG. 9*a* which act in an arc beneath the folding grip with a leaf spring shaped like as an inverted "V" or a " Я" then the cavities [13] in the pivotable folding grip would be available to house small watch batteries. Judicious selection of conductive and nonconductive materials for the frame and folding grip would allow the deployed or retracted position of the grip to act in tandem as a master on/off switch to the accessories.

According to other alternatives within the scope of the invention, the magazine well may incorporate a spring or compressed elastic element providing forward bias force to the magazine. Also, one or more ball detent mechanisms may be incorporated to run in the rear channel of the magazine well. They would be placed in line with the protruding hammer pin. A guide stud may also be provided in the magazine well above the intrusion of the firing pin to protect it from jamming damage. The pin would help with insertion of the magazine by allowing the user to align the bottom portion of the groove of the breech flap onto the pin and then complete the alignment with respect to the confines of the rest of the magazine well. It is also within the scope of the invention to exchange the magazine lugs and the trigger lifting surfaces, so the round lug is a feature or component of the trigger, and the cooperating angled lifting surfaces would reside on the magazine. Thus, although many exemplary embodiments are described above, it will be appreciated that the invention is intended to cover all modifications and equivalents within the scope of the following claims.

I claim:

1. A pistol comprising:

a frame; a barrel connected to the frame;

the frame having a grip portion defining an elongated magazine well;

an elongated magazine removably received in the well and defining a plurality of chambers each configured to contain an ammunition cartridge and having a bullet exit;

a trigger assembly connected to the frame;

the trigger assembly operably connected to the magazine to index the magazine along its length to sequentially align each chamber with the barrel, and to sequentially discharge each cartridge in the magazine;

the magazine having a fully loaded condition in which an uppermost chamber is registered with the barrel, and wherein the trigger assembly is operable when in the fully loaded condition to discharge a cartridge in the uppermost chamber, wherein the trigger assembly includes a first magazine engagement surface angled in a first orientation with respect to the magazine to drive the magazine downward in response to initial rearward movement of the trigger when the magazine is in an initial position with the uppermost chamber aligned with the barrel, and includes a second magazine engagement surface angled in a second orientation with respect to the magazine to elevate the magazine in an upward direction in response to subsequent rearward movement of the trigger to a position in which the uppermost chamber is registered with the barrel.

2. The pistol of claim 1, wherein subsequent rearward movements of the trigger operate to elevate the magazine without downward movement.

* * * * *